US009746245B2

(12) United States Patent
Jeon et al.

(10) Patent No.: US 9,746,245 B2
(45) Date of Patent: Aug. 29, 2017

(54) HEAT EXCHANGER EQUIPPED WITH COLD RESERVING PART AND MANUFACTURING METHOD THEREOF

(71) Applicant: Halla Visteon Climate Control Corp., Daejeon (KR)

(72) Inventors: Young-Ha Jeon, Daejeon (KR); Kwang Hun Oh, Daejeon (KR); Hong-Young Lim, Daejeon (KR); Jun Young Song, Daejeon (KR); Yong Sung Kwon, Daejeon (KR); Jung Sam Gu, Daejeon (KR)

(73) Assignee: HANON SYSTEMS, Daejeon-si (KR)

( * ) Notice: Subject to any disclaimer, the term of this patent is extended or adjusted under 35 U.S.C. 154(b) by 182 days.

(21) Appl. No.: 14/654,573

(22) PCT Filed: Jan. 24, 2014

(86) PCT No.: PCT/KR2014/000706

§ 371 (c)(1),
(2) Date: Jun. 22, 2015

(87) PCT Pub. No.: WO2014/116055

PCT Pub. Date: Jul. 31, 2014

(65) Prior Publication Data

US 2015/0345871 A1 Dec. 3, 2015

(30) Foreign Application Priority Data

Jan. 25, 2013 (KR) ..... 10-2013-0008369
Apr. 3, 2013 (KR) ..... 10-2013-0036232

(51) Int. Cl.
*F28F 9/02* (2006.01)
*F28D 7/00* (2006.01)
(Continued)

(52) U.S. Cl.
CPC ..... *F28D 7/0066* (2013.01); *F28D 1/0417* (2013.01); *F28F 9/0204* (2013.01);
(Continued)

(58) Field of Classification Search
CPC ..... F28F 9/0204; F28F 9/0256; F28D 1/0417; F28D 1/0333; F28D 7/0066; F28D 1/0435
(Continued)

(56) References Cited

U.S. PATENT DOCUMENTS 7,156,156 B2 1/2007 Haller et al.
7,891,412 B2 2/2011 Loup et al.
(Continued)

FOREIGN PATENT DOCUMENTS

CN 101460805 A 6/2009
JP 2000205777 A 7/2000
(Continued)

*Primary Examiner* — Davis Hwu
(74) *Attorney, Agent, or Firm* — Shumaker, Loop & Kendrick, LLP; James D. Miller

(57) ABSTRACT

Provided are a heat exchanger equipped with a cold reserving part and a manufacturing method thereof, equipped with a cold reserving part, in which since a cold reserving material charging part is formed at a portion at which an inlet and outlet member is formed, an additionally protruding part to inject the cold reserving material is not required, such that the heat exchanger may be miniaturized and may more rapidly and effectively absorb cold air to increase a cold reserving effect, and a manufacturing method of a heat exchanger equipped with a cold reserving part which forms the cold reserving material charging part to charge the cold reserving material after coating the heat exchanger to block a coating solution from introducing into the heat exchanger, thereby preventing the heat exchanger from corroding due to the coating solution to increase durability and more increase manufacturing performance.

13 Claims, 21 Drawing Sheets

(51) Int. Cl.

| | |
|---|---|
| ***F28D 1/04*** | (2006.01) |
| *F28D 21/00* | (2006.01) |
| *F28D 20/00* | (2006.01) |

(52) U.S. Cl.
CPC ..... *F28F 9/0256* (2013.01); *F28D 1/0435* (2013.01); *F28D 2020/0013* (2013.01); *F28D 2021/0085* (2013.01); *F28F 2275/04* (2013.01)

(58) Field of Classification Search
USPC ..... 165/173
See application file for complete search history.

(56) References Cited

U.S. PATENT DOCUMENTS

| | | | | |
|---|---|---|---|---|
| 2006/0113068 | A1* | 6/2006 | Desai | F28D 1/0417 165/140 |
| 2009/0120624 | A1* | 5/2009 | Lim | F28D 1/0333 165/158 |
| 2010/0018231 | A1 | 1/2010 | Haller et al. | |

FOREIGN PATENT DOCUMENTS

| | | | |
|---|---|---|---|
| KR | 1020070111390 | A | 11/2007 |
| KR | 20080103674 | A | 11/2008 |
| KR | 20120129417 | A | 11/2012 |
| WO | 2012150768 | A1 | 11/2012 |

* cited by examiner

HEAT EXCHANGER EQUIPPED WITH COLD RESERVING PART AND MANUFACTURING METHOD THEREOF

CROSS-REFERENCE TO RELATED APPLICATIONS

This application is a United States national phase application based on PCT/KR2014/000706 filed Jan. 24, 2014 which claims the benefit of Korean Patent Application No. 10-2013-0008369 filed Jan. 25, 2013 and Korean Patent Application No. 10-2013-0036232 filed Apr. 3, 2013. The entire disclosures of the above applications are hereby incorporated herein by reference.

FIELD OF THE INVENTION

The present invention relates to a heat exchanger equipped with a cold reserving part and a manufacturing method thereof, and more particularly, to a heat exchanger equipped with a cold reserving part, in which since a cold reserving material charging part is formed at a portion at which an inlet and outlet member is formed, an additionally protruding part to inject the cold reserving material is not required, such that the heat exchanger may be miniaturized and may more rapidly and effectively absorb cold air to increase a cold reserving effect, and a manufacturing method of a heat exchanger equipped with a cold reserving part which forms the cold reserving material charging part to charge the cold reserving material after coating the heat exchanger to block a coating solution from being introduced into the heat exchanger, thereby preventing the heat exchanger from corroding due to the coating solution to increase durability and more increase manufacturing performance.

BACKGROUND OF THE INVENTION

In the recent automotive industry, as the interest in environment and energy is increased around the world, research into improvement in fuel efficiency has been conducted and a research and development to implement weight reduction, miniaturization, and multi-functional performance to meet various consumer needs has been continuously conducted. In particular, a research and development for a hybrid vehicle simultaneously using power and electric energy tends to be increased.

The hybrid vehicle has mainly adopted an idle stop/go system which automatically stops an engine at the time of stopping, such as waiting for signal, and restarts the engine by operating a transmission again. However, even in the case of the hybrid vehicle, since an air conditioner is operated by the engine, when the engine stops, a compressor also stops, such that a temperature of an evaporator rises and thus comfortableness of a user deteriorates. Further, since a refrigerant inside the evaporator is easily evaporated even in a room temperature, the refrigerant is evaporated for a short period of time in which the compressor is not operated. Therefore, even though the engine is operated again to operate the compressor and the evaporator, there is a need to compress and liquefy the evaporated refrigerant, such that it takes much time to supply a cold wind to the interior of a room and the entire energy consumption may be increased.

Meanwhile, Japanese Patent Laid-Open Publication No. 2000-205777 (Title of the Invention: Heat Storage Heat Exchanger) has been proposed to increase cooling efficiency, which is illustrated in FIG. 1.

As illustrated in FIG. 1, the heat storage heat exchanger is characterized in that a heat exchange medium passage 191*e* through which a heat exchange medium is distributed and heat storage material chambers 191*f* and 191*f'* in which a heat storage material is stored are integrally formed by a tube 191 having a double pipe structure and an outside of the tube 191 having a double pipe structure is provided with a passage 194 through which a fluid heat-exchanged with the heat exchange medium is formed.

However, as illustrated in FIG. 1, the heat storage heat exchanger includes the tube formed by bonding several boards to each other, such that the bonding defect may frequently occur, is formed to have the double pipe structure, such that it is difficult to be manufactured, and has a problem in that the heat exchange medium therein is mixed with the heat storage material when the bonding defect occurs. Further, even though the bonding defect occurs, it is difficult to find out the bonding defect portion.

Further, the heat storage heat exchanger has a problem in that since the inside of the double pipe is provided with a passage through which the heat exchange medium moves and the outside thereof is provided with the heat reserving material chamber in which the heat reserving material is formed, the heat storage material easily stores the cold air of the heat exchange medium therein but air passing through the outside of the double pipe structure contacts the heat reserving material chamber to reduce a heat transfer of the heat exchange medium. Further, a fin inserted into the outside of the double pipe tube also contacts the heat storage material chamber but is not directly connected to the heat exchange medium passage, thereby reducing the heat exchange efficiency.

To solve the above-mentioned problem, the present applicant has proposed Korean Patent Laid-Open Publication No. 2007-0111390 (Title of the Invention: Cold Reserving Part Equipped Evaporator), which is illustrated in FIG. 2.

In Korean Patent Laid-Open Publication No. 2007-0111390 illustrated in FIG. 2, a tube 30 formed by bonding a pair of plates 10 having left and right sides each provided with refrigerant passages 11*a* and 11*b* is used and a cold reserving part 20 in which a cold reserving material is stored is formed between the refrigerant passages 11*a* and 11*b* of the tube 30.

Meanwhile, the heat exchanger equipped with a cold reserving part has a problem in that as the refrigerant and the cold reserving material each move, a component to charge a cold reserving material is required along with a pipe for providing the introduction and discharging of a refrigerant and when a component for charging the cold reserving material protrudes to the outside, it is difficult to prevent miniaturization and a space in which the refrigerant moves or a storage space in which the cold reserving material is stored is reduced so much.

Further, since condensed water may be formed on an outer surface of the heat exchanger for air conditioning, the heat exchanger easily discharges the condensed water by coating a coating solution on the outer surface thereof, suppresses a smell from occurring, and suppresses inhabitation of mold, and the like.

Generally, the coating processing dips the heat exchanger in a coating solution and dries the coating solution to form a coating layer and the coating solution introduced into the heat exchanger may corrode the heat exchanger and thus reduce the overall durability of the heat exchanger.

However, the heat exchanger equipped with a cold reserving part has a problem in that it is highly likely to introduce the coating solution into the heat exchanger through a part to charge the cold reserving material and thus a separate process to seal the part to charge the cold reserving material is required.

In addition, the heat exchanger equipped with a cold reserving part according to the related art illustrated in FIG. 1 has the double pipe form and when the coating solution is introduced into the heat exchanger, hardly removes the coating solution, such that the occurrence frequency of defects may be increased due to the introduction of the coating solution, thereby causing the reduction in productivity.

Therefore, a need exists for a heat exchanger to be able to expect the rapid and high cold reserving performance, prevent corrosion due to the coating solution, and increase the durability and manufacturing performance.

Patent Document 1) Japanese Patent Laid-Open Publication No. 2000-205777 (Title of the Invention: Heat Storage Heat Exchanger)

Patent Document 2) Korean Patent Laid-Open Publication No. 2007-0111390 (Title of the Invention: Cold Reserving Part Equipped Evaporator)

SUMMARY OF THE INVENTION

An object of the present invention is to provide a heat exchanger equipped with a cold reserving part, in which since a cold reserving material charging part is formed at a portion at which an inlet and outlet member is formed, an additionally protruding part to inject the cold reserving material is not required, such that the heat exchanger may be miniaturized, may more rapidly and effectively absorb cold air to increase a cold reserving effect, and manufacturing performance of the heat exchanger may be increased.

Another object of the present invention is to provide a heat exchanger equipped with a cold reserving part which may be applied to various forms of inlet and outlet member by forming a cold reserving material charging part to communicate with a second column of a cap in the case of a form in which an inlet pipe and an outlet pipe are connected to the cap and forming the cold reserving material charging part in a manifold in the case in a form in which the manifold is used.

Still another object of the present invention is to provide a heat exchanger equipped with a cold reserving part, in which a tube is an extrusion type tube in which three columns are integrally formed, direct heat conduction is performed between a heat exchange medium and a cold reserving material to increase heat exchange efficiency, thereby facilitating manufacturing, and simplifying an assembling process.

Yet another object of the present invention is to provide a heat exchanger equipped with a cold reserving part in which a seating groove seated with a sealing member is formed in a cold reserving material charging part to be able to secure salability with a stopper.

Still yet another object of the present invention is to provide a heat exchanger equipped with a cold reserving part and a manufacturing method of a heat exchanger equipped with a cold reserving part which form a cold reserving material charging part to charge a cold reserving material after coating the heat exchanger to block a coating solution from introducing into the heat exchanger, thereby preventing the heat exchanger from corroding due to the coating solution to increase durability and more increase manufacturing performance.

Technical Solution

According to an embodiment of the present invention, there is provided a heat exchanger equipped with a cold reserving part, including: a first header tank 201 and a second header tank 202 which are provided in parallel to be spaced apart from each other at a predetermined distance and are partitioned in an air flow direction by a barrier rib 213 to form a first compartment 213*a* to a third compartment 213*c*; tubes 110 of three columns which have both ends fixed to the first compartment 213*a* to the third compartment 213*c* of the first header tank 201 and the second header tank 202, respectively; and an inlet and outlet forming member 300 which is mounted in the first header tank 201 and the second header tank 202 to provide the introduction and discharging of a heat exchange medium, wherein one of the first to third columns of the tube 110 is stored with a cold reserving material, the inlet and outlet forming member 300 is mounted at one side of the first header tank 201, and one portion of the first header tank 201 formed with the input and output forming member 300 is provided with a cold reserving material charging part 610 which communicates with one of the first compartment 213*a* to the third compartment 213*c* stored with the cold reserving material to be charged with the cold reserving material.

A heat exchange medium may move in the tube 110 of the first column and the third column, the cold reserving material may be stored in the tube 110 of the second column, and the cold reserving material charging part 610 may be formed to communicate with the second compartment 213*b*.

A predetermined region of the second compartment 213*b* of the first header tank 201 or the second header tank 202 may be provided with a communication part 214 which communicates the first compartment 213*a* and the third compartment 213*c* with each other to move the heat exchange medium.

An inlet pipe 510 into which the heat exchange medium is introduced and an outlet pipe 520 from which the heat exchange medium is discharged may communicate with the first compartment 213*a* to the third compartment 213*c* of the first header tank 201, respectively, and the heat exchange medium introduced through the inlet pipe 510 may be discharged through the outlet pipe 520 via: a first region A1 in which the heat exchange medium moves to the first compartment 213*a* of the second header tank 202 through the tube 110 forming the first column while moving in a longitudinal direction of the first compartment 213*a*; a second region A2 in which the heat exchange medium moves to the first compartment 213*a* of the first header tank 201 through the tube 110 while moving in the longitudinal direction of the first compartment 213*a* of the second header tank 202; a third region A3 in which the heat exchange medium moves to the first compartment 213*a* of the second header tank 202 through the tube 110 while moving in the longitudinal direction of the first compartment 213*a* of the first header tank 201; a fourth region A4 in which the heat exchange medium moves to the third compartment 213*c* of the first header tank 201 through the tube 110 while moving to the third compartment 213*c* of the second header tank 202 through the communication part 115 and moving in a longitudinal direction of the third compartment 213*c* of the second header tank 202; a fifth region A5 in which the heat exchange medium moves to the third compartment 213*c* of the second header tank 202 through the tube 110 while moving in the longitudinal direction of the third compartment 213*c* of the first header tank 201; and a sixth region A6 in which the heat exchange medium moves to the third compartment 213*c* of the first header tank 201 through the tube 110 while moving in a longitudinal direction of the third compartment 213*c* of the second header tank 202.

The inlet and outlet forming member 300 may include: an inlet pipe 510 which communicates with the first compartment 213*a* to introduce the heat exchange medium into one portion of an end cap 440 closing both ends of the first header tank 201 and an outlet pipe 520 which communicates with a third compartment 213*c* to discharge the heat exchange medium to one portion of the end cap 440, and the cold reserving material charging part 610 may be formed in the end cap 440 which is connected to the inlet pipe 510 and the outlet pipe 520 so as to communicate with the second compartment 213*b*.

The inlet and outlet forming member 300 may include: a manifold 400 which is mounted at one portion of the first header tank 201, the inlet pipe 510 which is connected to the manifold 400 to be introduced with the heat exchange medium and the outlet pipe 520 which is connected to the manifold 400 to discharge the heat exchange medium, and the cold reserving material charging part 610 may be mounted in the manifold 400 to communicate with the second compartment 213*b*.

The manifold 400 may include: a lower manifold 410 which has a "ㄷ"-letter shape formed of a first region 431 corresponding to one portion of the first header tank 201 and a second region 432 of which a lower surface of a predetermined region forming the first compartment 213*a* of the first region 431 extends forward from a lower portion thereof and is provided with an inlet hole which communicates with the first compartment 213*a*, the cold reserving material charging part 610 which communicates with the second compartment 213*b*, and an outlet hole which communicates with the third compartment 213*c*; and an upper manifold 420 which has a shape corresponding to the lower manifold 410 and is coupled with a region formed with the inlet hole to form an inlet side heat exchange medium passage and coupled with a region formed with the outlet hole to form an outlet side heat exchange medium passage and is provided with a hollow part 421 hollowed to protrude the cold reserving material charging part 610.

The cold reserving material charging part 610 may be closed by a stopper 620 including a head part 621 and a fixed part 622 protruding at one portion of the head part 621.

An inner peripheral surface of the cold reserving material charging part 610 may be provided with a support part 613 protruding in a longitudinal direction to correspond to the fixed part 622 of the stopper 620.

The heat exchanger equipped with a cold reserving part may further include: a sealing member pressed by the head part 621 of the stopper 620, wherein the cold reserving material charging part 610 is provided with a seating groove 612 in which the sealing member 630 is seated.

The tube may be an extrusion type tube 110 in which the tubes 110 of three columns are integrally formed and an integrated fin 120 may be further provided between the tubes 110.

According to another embodiment of the present invention, there is provided a manufacturing method of a heat exchanger equipped with a cold reserving part, including: temporarily assembling (S10) the heat exchanger 1000 equipped with a cold reserving part including a first header tank 201 and a second header tank 202 which are provided in parallel to be spaced apart from each other at a predetermined distance and are partitioned in an air flow direction by a barrier rib 213 to form a first compartment 213*a* to a third compartment 213*c*; tubes 110 of three columns which have both ends fixed to the first compartment 213*a* to the third compartment 213*c* of the first header tank 201 and the second header tank 202, respectively; and an inlet and outlet forming member 300 which is mounted in the first header tank 201 and the second header tank 202 to provide the introduction and discharging of a heat exchange medium; brazing (S20) the temporarily assembled heat exchanger 1000 equipped with a cold reserving part; coating (S30) the brazed heat exchanger 1000 equipped with a cold reserving part using a coating solution; forming (S40) The cold reserving material charging part 610 in a predetermined region of the first header tank 201 or the second heater tank 202 so that the cold reserving material is stored in a specific column of the coated heat exchanger 1000 equipped with a cold reserving part; and charging the cold reserving material (S50) To close the cold reserving material charging part 610 after charging the cold reserving material through the cold reserving material charging part 610.

The coating (S30) may include: dipping (S41) the brazed heat exchanger 1000 equipped with a cold reserving part in a coating solution; and drying (S42).

The manufacturing method of a heat exchanger equipped with a cold reserving part may further include: after the charging of the cold reserving material (S50), testing whether the heat exchange medium and the cold reserving material are leaked (S60).

Advantageous Effects

Therefore, according to the heat exchanger equipped with a cold reserving part according to the exemplary embodiments of the present invention, since the cold reserving material charging part is formed at the portion at which the inlet and outlet member is formed, the additionally protruding part to inject the cold reserving material is not required, such that the heat exchanger may be miniaturized, may more rapidly and effectively absorb the cold air to increase the cold reserving effect, and the manufacturing performance of the heat exchanger may be increased.

In particular, according to the heat exchanger equipped with a cold reserving part according to the exemplary embodiments of the present invention, the cold reserving material charging part is formed to communicate with the second column of the cap in the case of the form in which the inlet pipe and the outlet pipe are connected to the cap and the cold reserving material charging part is formed in the manifold in the case in the form in which the manifold is used, such that the heat exchanger may be applied to various forms of inlet and outlet member.

Further, according to the heat exchanger equipped with a cold reserving part according to the exemplary embodiments of the present invention, the tube is the extrusion type tube in which the three columns are integrally formed and the direct heat conduction is performed between the heat exchange medium and the cold reserving material to increase the heat exchange efficiency, thereby facilitating the manufacturing and simplifying the assembling process.

Further, according to the heat exchanger equipped with a cold reserving part according to the exemplary embodiments of the present invention, the cold reserving material charging part is provided with the seating groove seated with the sealing member to be able to secure the salability with the stopper.

Further, according to the heat exchanger equipped with a cold reserving part and the manufacturing method of a heat exchanger equipped with a cold reserving part according to the present invention, the cold reserving material charging part to charge the cold reserving material after coating the heat exchanger is formed to block the coating solution from introducing into the heat exchanger, thereby preventing the heat exchanger from corroding due to the coating solution to increase the durability and more increase the manufacturing performance.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF EXEMPLARY EMBODIMENTS OF THE INVENTION

Figure 1:
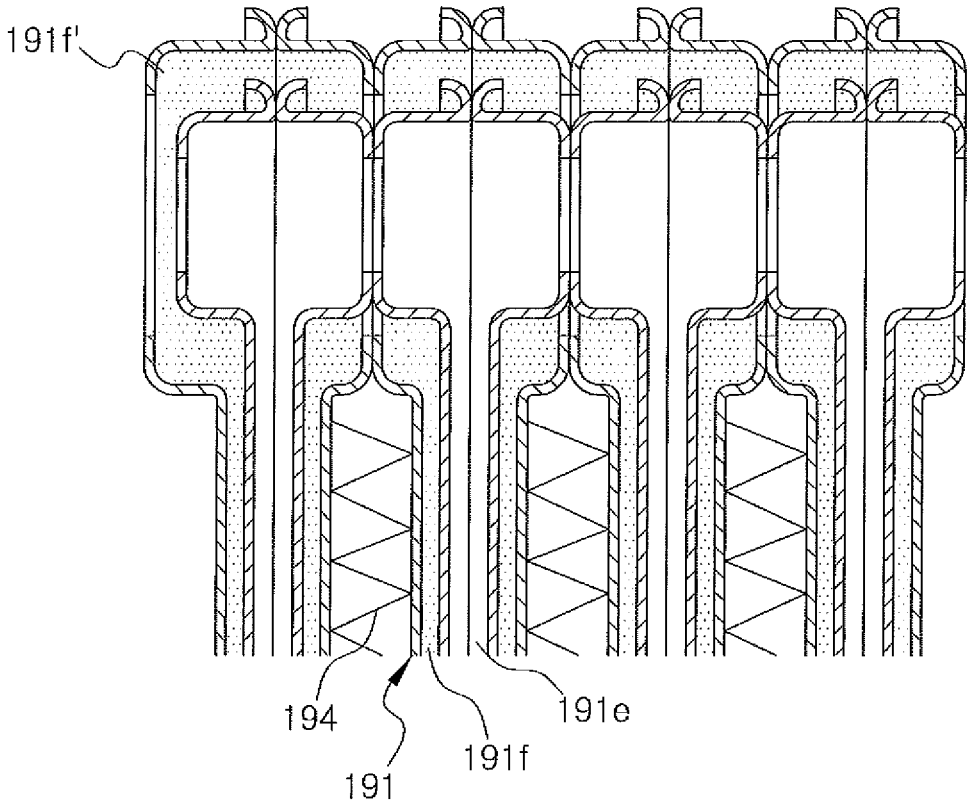
PRIOR ART FIG. 1
FIGS. 1 and 2 each are diagrams illustrating a heat exchanger according to the related art.
Figure 2:
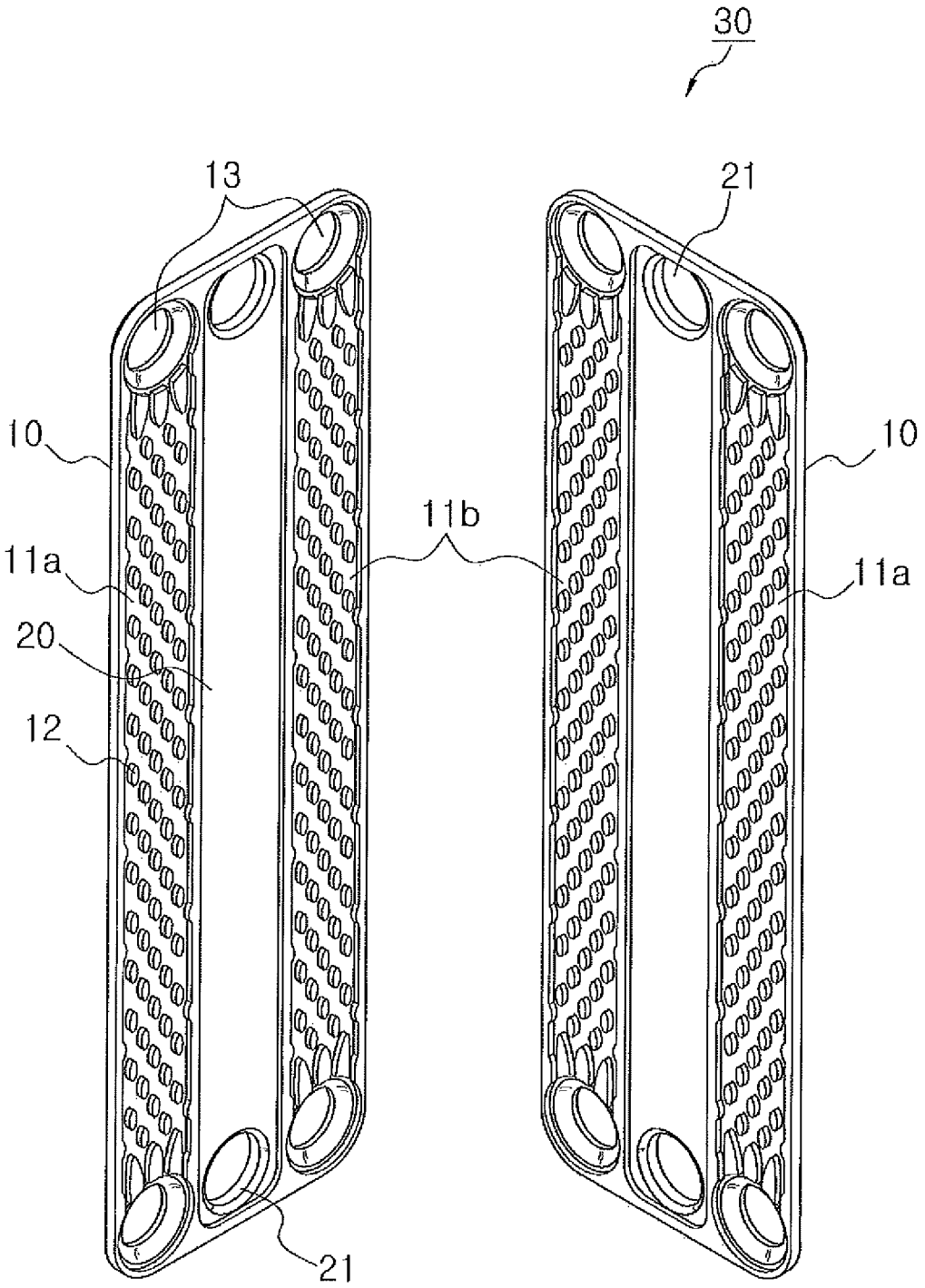
PRIOR ART FIG. 2

Hereinafter, exemplary embodiments of the present invention will be described below in detail with reference to the accompanying drawings.

A heat exchanger 1000 equipped with a cold reserving part according to an exemplary embodiment of the present invention is configured to include a first header tank 201, a second header tank 202, tubes 110 of three columns, and an inlet and outlet forming member 300, and a cold reserving material charging part 610.

The first header tank 201 and the second header tank 202 are disposed in parallel to be spaced apart from each other at a predetermined distance and are partitioned in an air flow direction (width direction) by a barrier rib 213 to include a first compartment 213*a* to a third compartment 213*c* formed therein.

The first header tank 201 and the second header tank 202 are provided with the inlet and outlet forming member 300 to be introduced with a heat exchange medium and move the heat exchange medium to the tube 110 and forms a space from which the heat exchange medium is discharged again.

The first header tank 201 and the second header tank 202 may be formed by a coupling of a header 210 and a tank 220, in which the header 210 may include a plane part 211, a coupling part 212, and the barrier rib 213.

The plane part 211 has a configuration in which a tube insertion hole 211-1 is hollowed so that an end of the tube 110 is inserted and has a plate shape.

The coupling part 212 is configured to extend in a width direction of the heat exchanger and extend in a height direction at both ends of the plane part 211 to form an entire cross section of the header 210 in a "ㄷ"-letter shape and adheres to the tank 220 to serve to fix the tank 220.

The barrier rib 213 is configured to partition the first compartment 213*a* which protrudes on the plane part 211 in the same direction as the coupling part 212 to communicate with a first column of the tube 110, the second compartment 213*b* which communicates with a second column of the tube 110, and the third compartment 213*c* which communicates with a third column of the tube 110.

Figure 3:
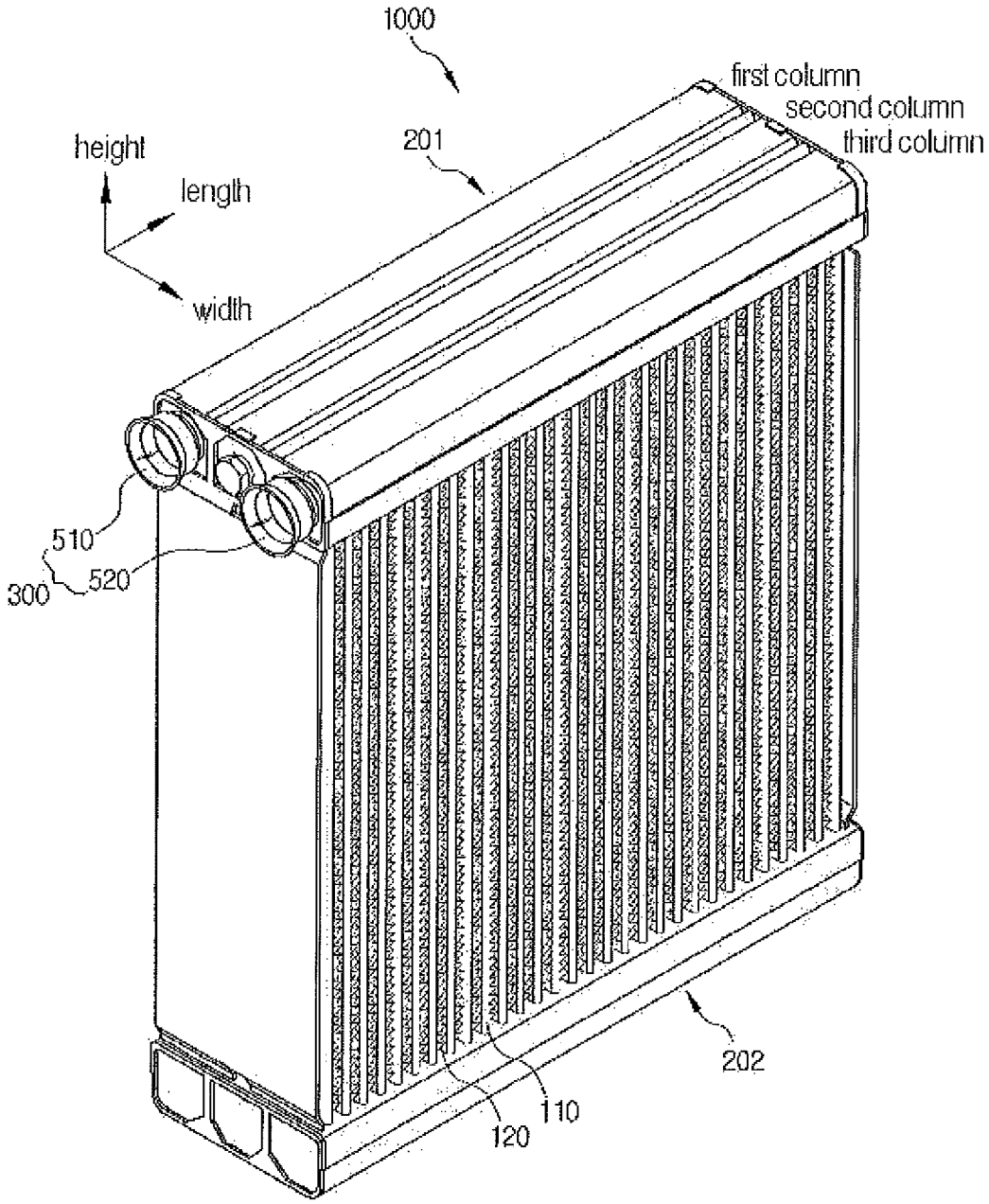
FIGS. 3 to 5 are a perspective view, a partially exploded perspective view, and a fragmentary cross-sectional view of a heat exchanger equipped with a cold reserving part according to an exemplary embodiment of the present invention.

FIG. 3 illustrates an example in which the barrier rib 213 is integrally formed with the header 210.

The tubes 110 of three columns have both ends fixed to the first compartment 213*a* to the third compartment 213*c* of the first header tank 201 and the second header tank 202, respectively.

One of the first to third columns of the tube 110 is stored with a cold reserving material and the heat exchange medium moves in the rest two thereof.

As illustrated in FIG. 3, in the heat exchanger equipped with the cold reserving part, the heat exchange medium moves in the tubes 110 of the first column and the third column, the cold reserving material may be stored in the tube 110 of the second column, and the cold reserving material charging part 610 may be formed to communicate with the second compartment 213*b*.

However, the heat exchange medium also moves in the first compartment 213*a* of the first header tank 201 and the second header tank 202 which communicates with the first column and the third compartment 213*c* of the first header tank 201 and the second header tank 202 which communicates with the third column.

However, the second compartment 213*b* of the first header tank 201 and the second header tank 202 which communicates with the second column 213*b* is stored with the cold reserving material and a predetermined region thereof may be provided with a communication part 214 which is partitioned from a space in which the cold reserving material is stored, as a passage through which the heat exchange medium communicates between the first compartment 213*a* and the third compartment 213*c*.

In this case, as the tubes 110 of three columns, to increase manufacturing performance and assembling performance, an extrusion type in which the three columns are integrally formed may be used.

Further, in the case of using the extrusion type tube 110, the heat is exchanged by the direct heat conduction along with the indirection heat exchange of the heat exchange medium and the cold reserving material due to the movement of air, such that the cold reserving material may efficiently store the cold air of the heat exchange medium.

Further, in the heat exchanger 1000 equipped with a cold reserving part according to the exemplary embodiment of the present invention, an integrated fin 120 may be further mounted between the tubes 110, thereby more increasing the heat exchange performance between air and the heat exchange medium or between air and the cold reserving material.

The inlet and outlet forming member 300 is configured to be mounted in the first header tank 201 and the second header tank 202 to provide the introduction and discharging of the heat exchange medium.

In this case, the inlet and outlet forming member 300 is mounted at one portion of the first header tank 201 and the cold reserving material charging part 610 is mounted at one portion of the first header tank 201 formed with the inlet and output forming member 300.

The cold reserving material charging part 610 communicates with the second compartment 213*b* to form a space in which the cold reserving material is charged and is formed to be opened and closed by a stopper 620.

Generally, the stopper 620 may be formed to include a head part 621 and a fixed part 622 which protrudes at one portion of the head part 621.

Representatively, the cold reserving material charging part 610 and the stopper 620 may be fixed by various fixing manners, representatively, a hollowed inner peripheral surface of the cold reserving material charging part 610 may be provided with a screw thread 611, and the fixing part 622 of the stopper 620 may be formed to correspond to the screw thread 611.

Figure 9:
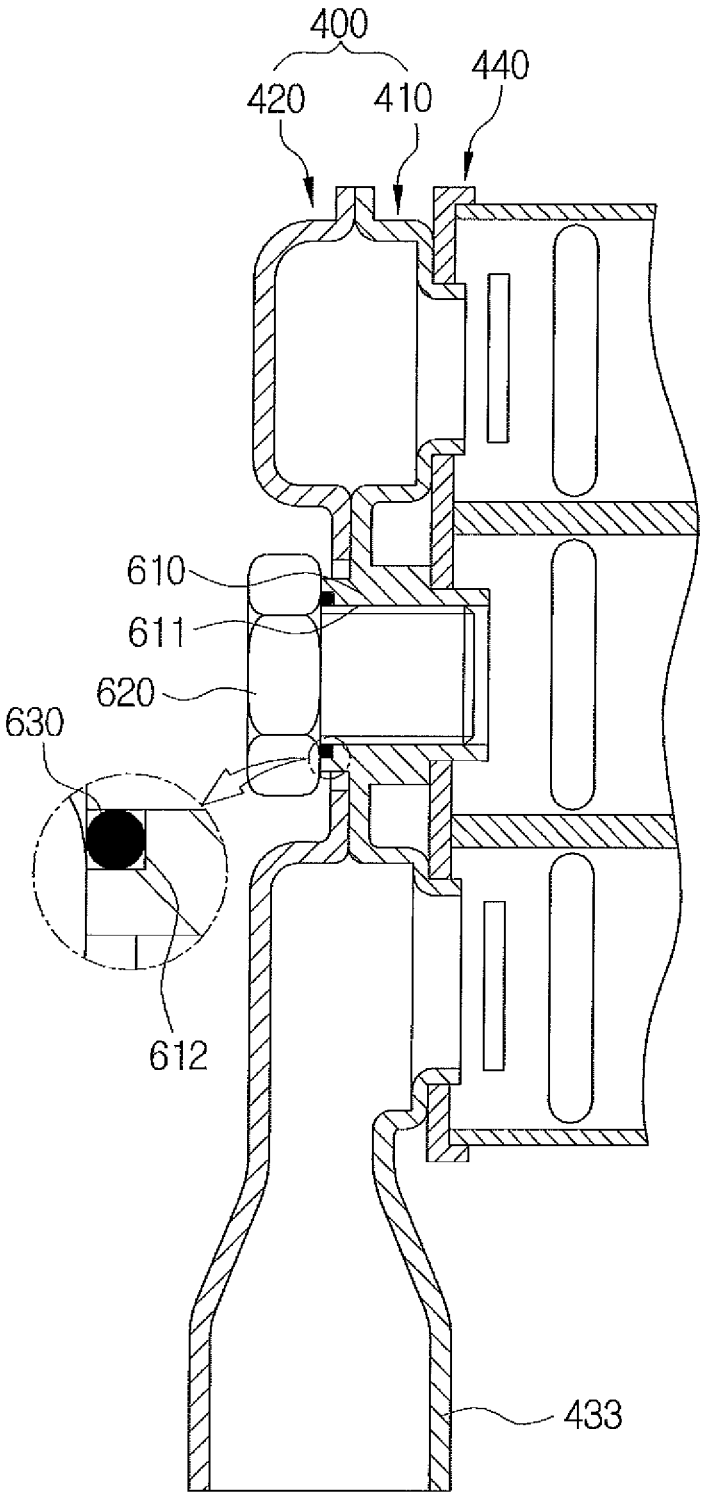

Further, in the heat exchanger 1000 equipped with a cold reserving part according to the exemplary embodiment of the present invention, a portion which adheres to the stopper 620 of the cold reserving material charging part 610 may be further provided with a seating groove 612 seated with a sealing member 630 (see FIG. 9).

The sealing groove 612 may be formed at an upper portion of a region in which the screw thread 611 is formed and as the sealing member 630, an O-ring may be used.

In this case, when the stopper 620 is coupled with the screw thread 611 of the cold reserving material charging part 610 in the state in which the sealing member 630 is fixed to the stopper 620, the sealing member 630 may be seated in the seating groove 612.

In addition to this, a shape of the cold reserving material charging part 610 may be variously changed, and therefore various examples will be further described in the following exemplary embodiments of the present invention.

Meanwhile, the inlet and output forming member 300 may be manufactured by various methods and therefore the cold reserving material charging part 610 may also be variously formed.

Figure 4:
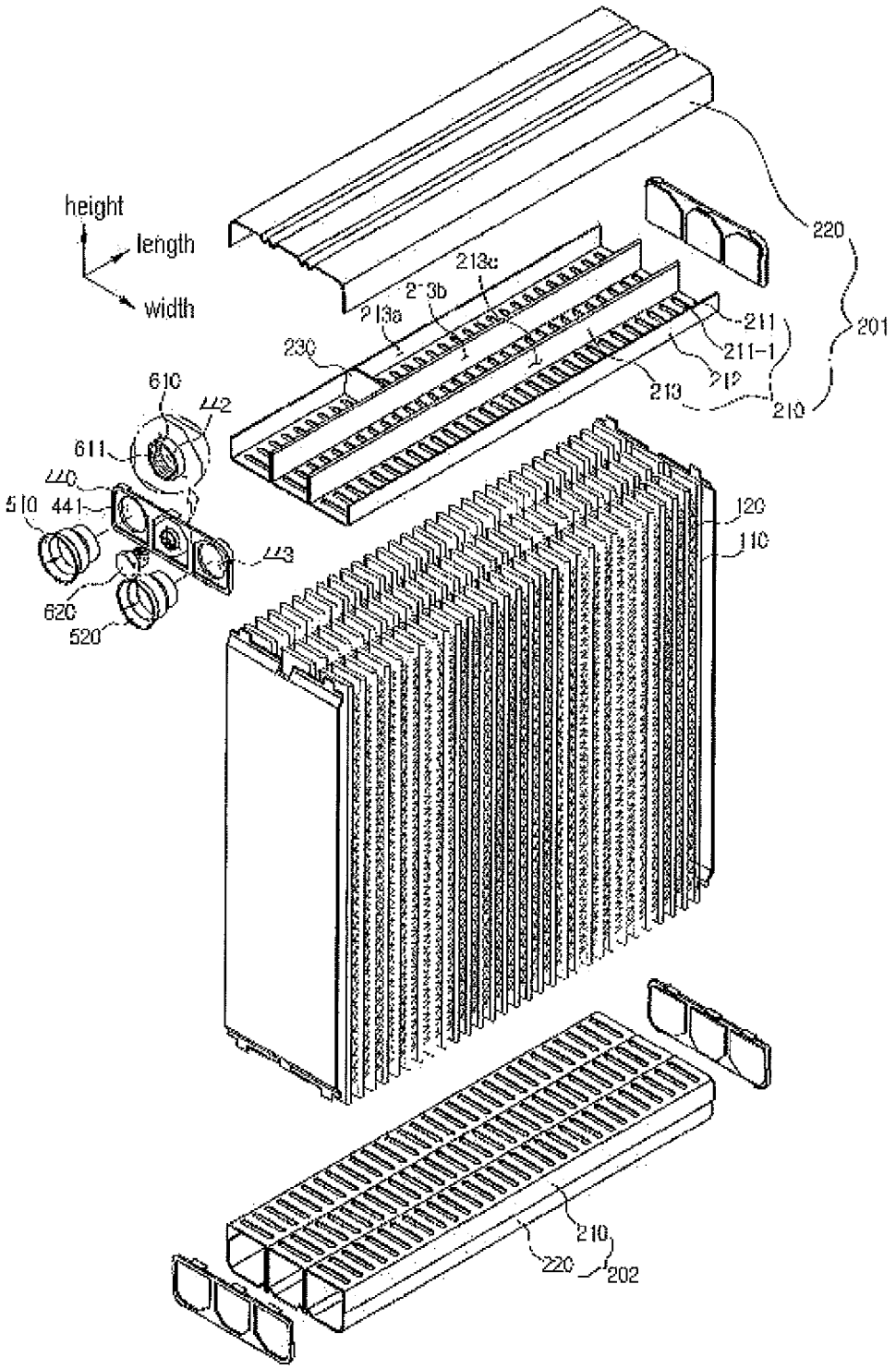
Figure 5:
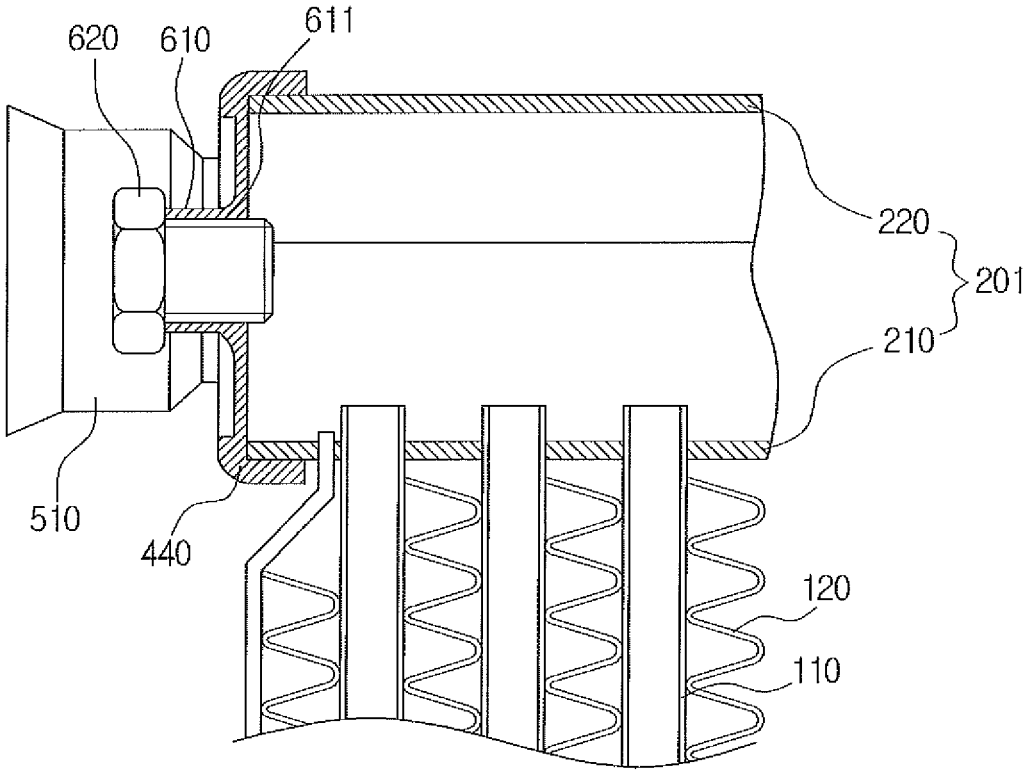
Figure 6:
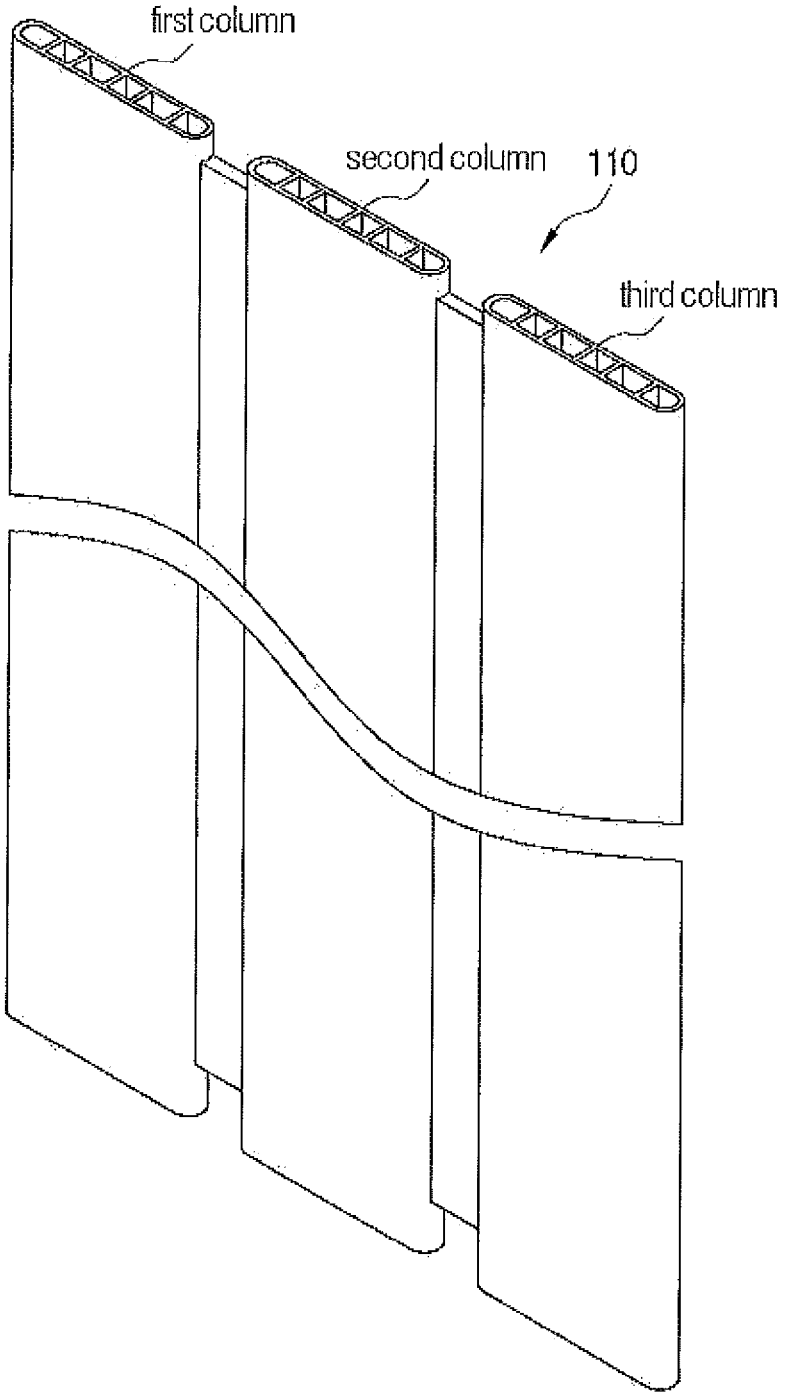
FIG. 6 is a fragmentary perspective view illustrating a tube of the heat exchanger equipped with a cold reserving part according to an exemplary embodiment of the present invention.

FIGS. 3 to 5 are perspective view, exploded perspective view, and cross-sectional view of the heat exchanger 1000 equipped with a cold reserving part according to the exemplary embodiment of the present invention. In this case, in the heat exchanger 1000 equipped with a cold reserving part illustrated in FIGS. 3 to 5, an example in which the inlet and outlet forming member 300 is configured to include an inlet pipe 510 which communicates with the first compartment 213*a* to introduce the heat exchange medium into one portion of an end cap 440 closing both ends of the first header tank 201 and an outlet pipe 520 which communicates with a third compartment 213*c* to discharge the heat exchange medium to one portion of the end cap 440 is illustrated.

In this case, the cold reserving material charging part 610 may be formed in the end cap 440 which is connected to the inlet pipe 510 and the outlet pipe 520 so as to communicate with the second compartment 213*b*.

The cold reserving material charging part 610 is integrally formed with the end cap 440, and at the time of manufacturing the shape of the end cap 440, is integrally manufactured with or separately manufactured from the end cap 440 and then may be bonded with the end cap 440 by various bonding methods (for example, welding, mechanical coupling, and the like).

Figure 7:
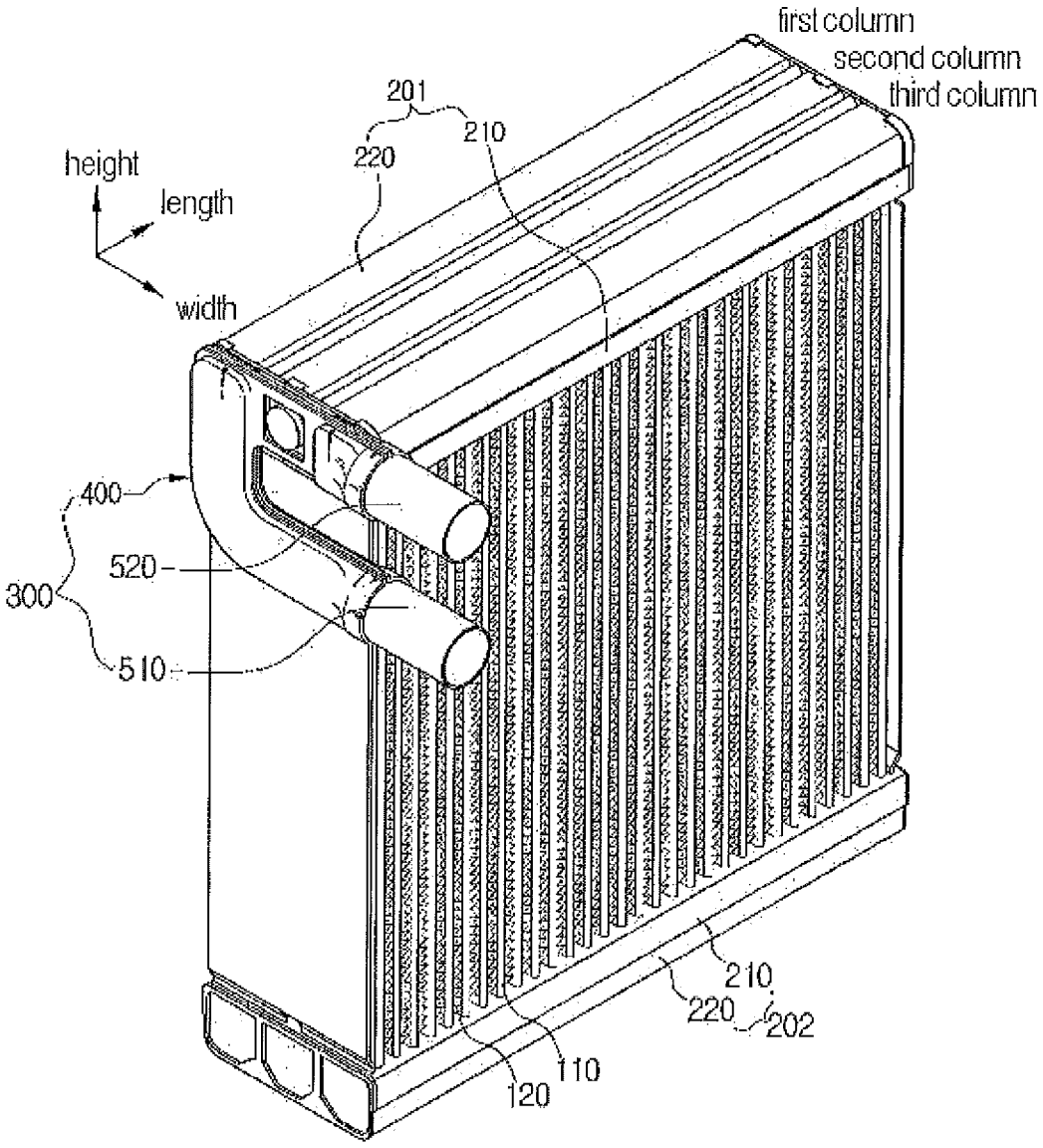
FIGS. 7 to 9 are a perspective view, a partially exploded perspective view, and a fragmentary cross-sectional view of the heat exchanger equipped with a cold reserving part according to an exemplary embodiment of the present invention.
Figure 8:
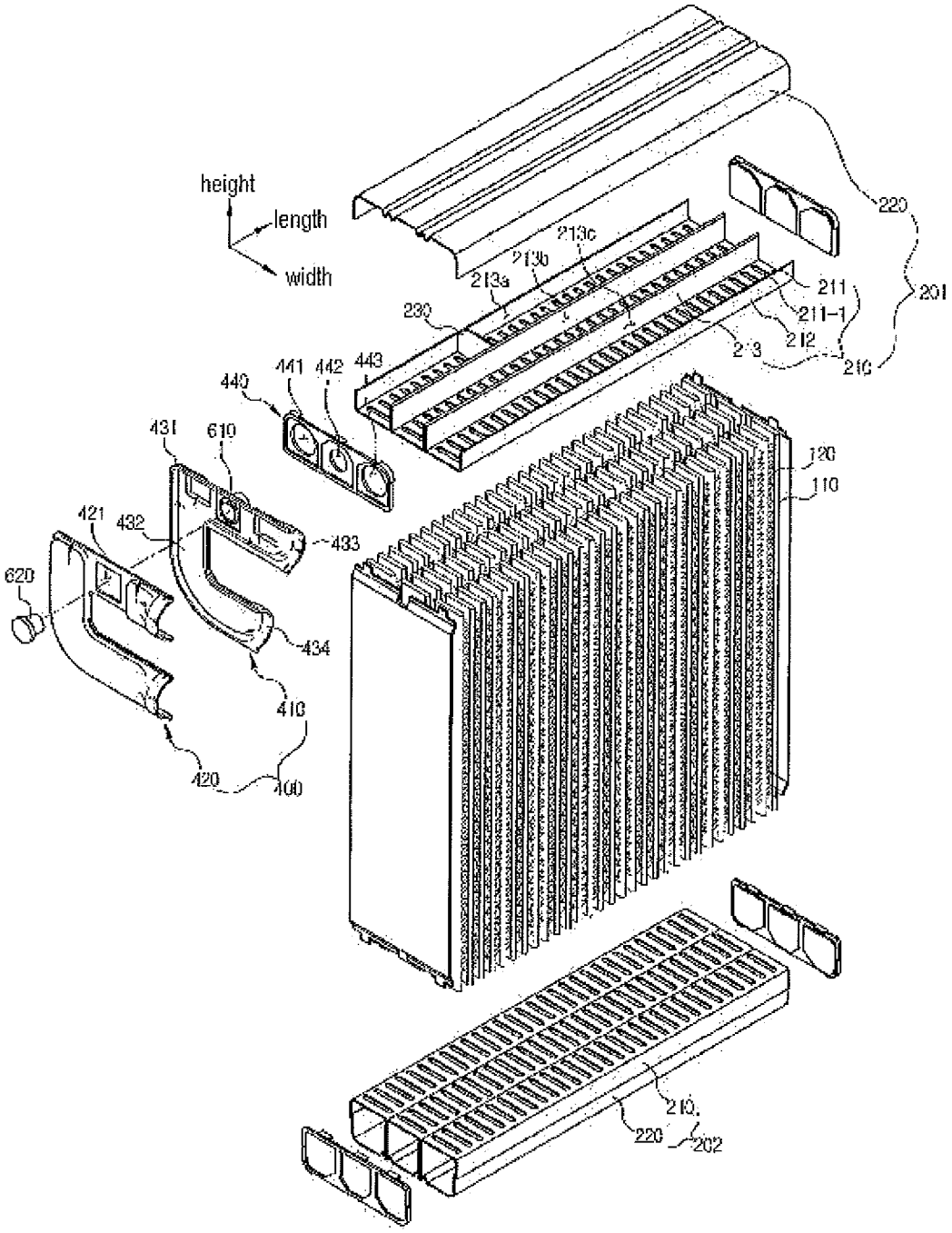

FIGS. 7 to 9 are another perspective view, exploded perspective view, and cross-sectional view of the heat exchanger 1000 equipped with a cold reserving part according to the exemplary embodiment of the present invention. In this case, an example in which the inlet and outlet forming member 300 illustrated in FIGS. 7 to 9 includes a manifold 400 which is mounted at one portion of the first header tank 201, the inlet pipe 510 which is connected to the manifold 400 to be introduced with the heat exchange medium and the outlet pipe 520 which is connected to the manifold 400 to discharge the heat exchange medium is illustrated.

In this case, the cold reserving material charging part 610 is mounted in the manifold 400 to communicate with the second compartment 213*b*.

In more detail, FIGS. 7 to 9 illustrate an example in which one portion of the first header tank 201 provided with the inlet and outlet forming member 300 is closed by the end cap 440 and the end cap 440 is formed with a first hole 441 which is hollowed to communicate with the first compartment 213*a*, a second hole 442 hollowed to communicate with the second compartment 213*b*, and a third hole 443 which is hollowed to communicate with the third compartment 213*c*.

The heat exchanger 1000 equipped with a cold reserving part according to the exemplary embodiment of the present invention is not provided with the end cap 440 and one end of the first header tank 201 may also be directly connected with the manifold 400.

In more detail, the manifold 400 is configured of a lower manifold 410 and an upper manifold 420.

The lower manifold 410 has a "ㄷ"-letter shape which is formed of a first region 431 corresponding to one portion of the first header tank 201 and a second region 432 of which a lower surface of a predetermined region forming the first compartment 213*a* of the first region 431 extends forward from a lower portion thereof and is provided with an inlet hole which communicates with the first compartment 213*a*, the cold reserving material charging part 610 which communicates with the second compartment 213*b*, and an outlet hole which communicates with the third compartment 213*c*.

The upper manifold 420 has a shape corresponding to the lower manifold 410 and is coupled with a region formed with the inlet hole to form an inlet side heat exchange medium passage and coupled with a region formed with the outlet hole to form an outlet side heat exchange medium passage and is provided with a hollow part 421 hollowed to protrude the cold reserving material charging part 610.

An end (first region 431) forming the outlet side heat exchange medium passage of the manifold 400 extends forward and is expanded to form a first extension 433, in which the first extension 433 is connected to the outlet pipe 520.

Further, an end (second region 432) forming the inlet side heat exchange medium passage of the manifold 400 extends forward and is expanded to form a second extension 434, in which the second extension 434 is connected to the inlet pipe 510.

Figure 11:
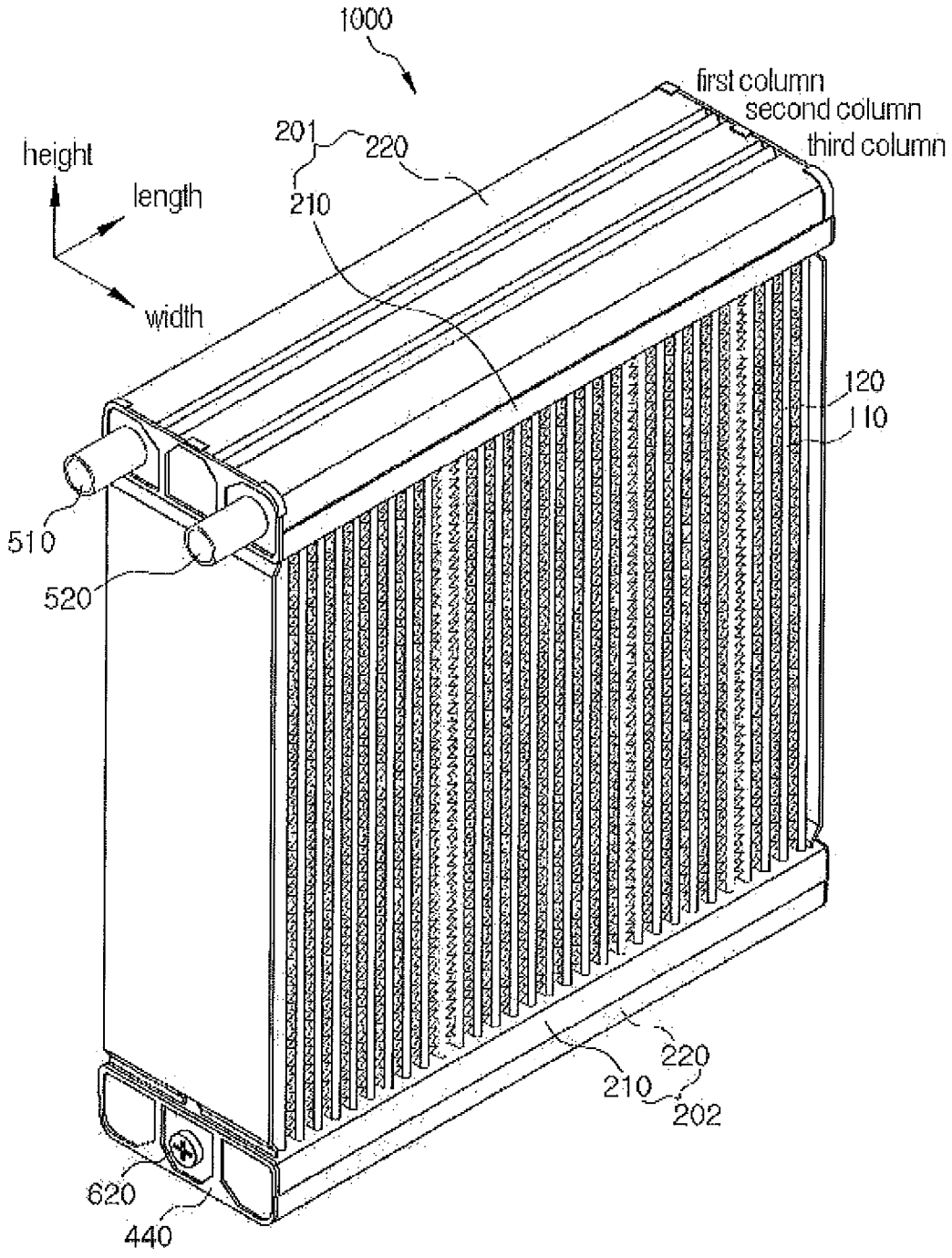
FIGS. 11 and 12 are a perspective view and a partially exploded perspective view illustrating a heat exchanger equipped with a cold reserving part according to another exemplary embodiment of the present invention.
Figure 12:
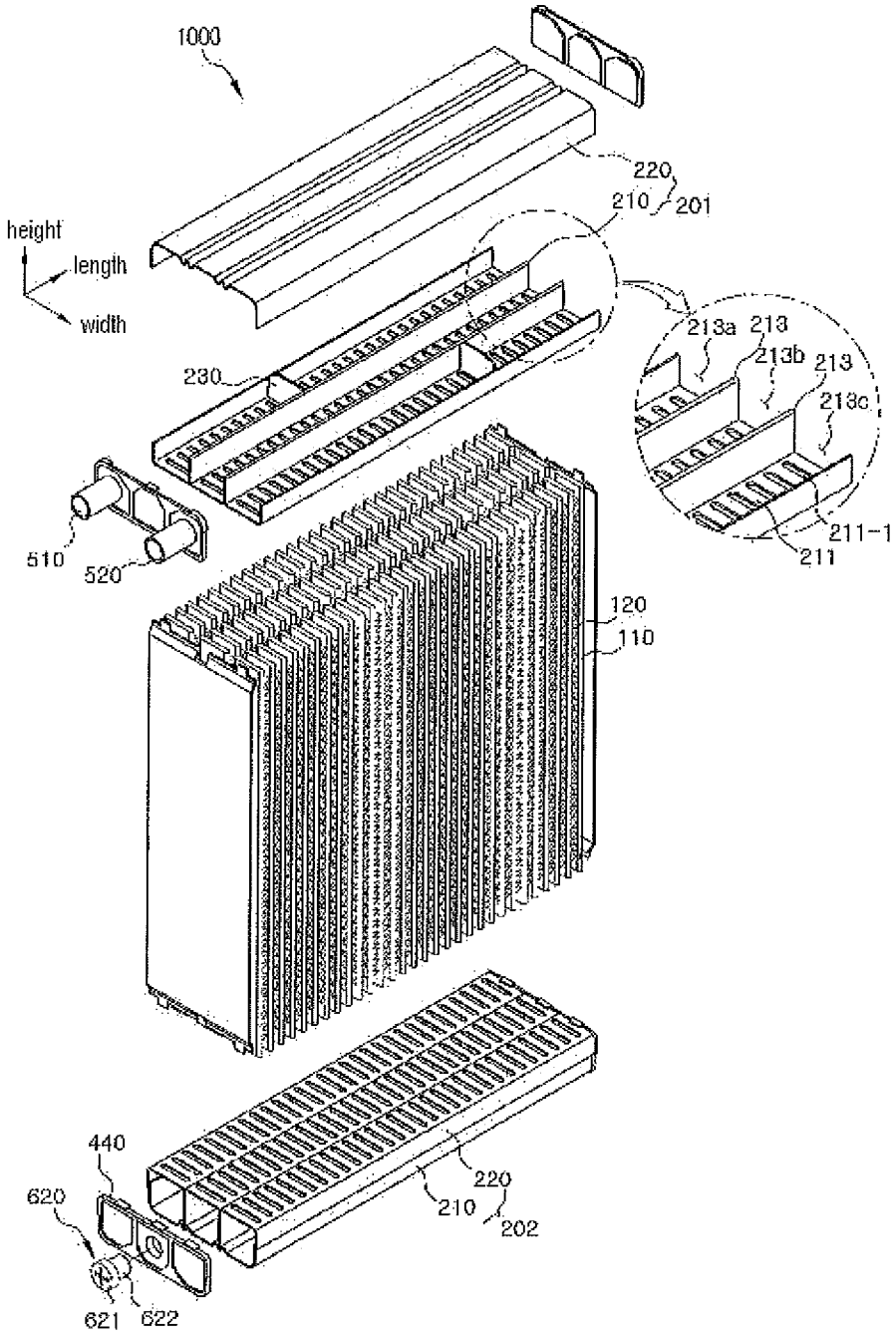

According to another exemplary embodiment of the present invention, in the heat exchanger 1000 equipped with a cold reserving part illustrated in FIGS. 11 and 12, an example in which the end cap 440 mounted at the left of the second header tank 202 which is one of the end caps 440 closing both ends of the first header tank 201 and the second header tank 202 is provided with the cold reserving material charging part 610 is illustrated.

Figure 13:
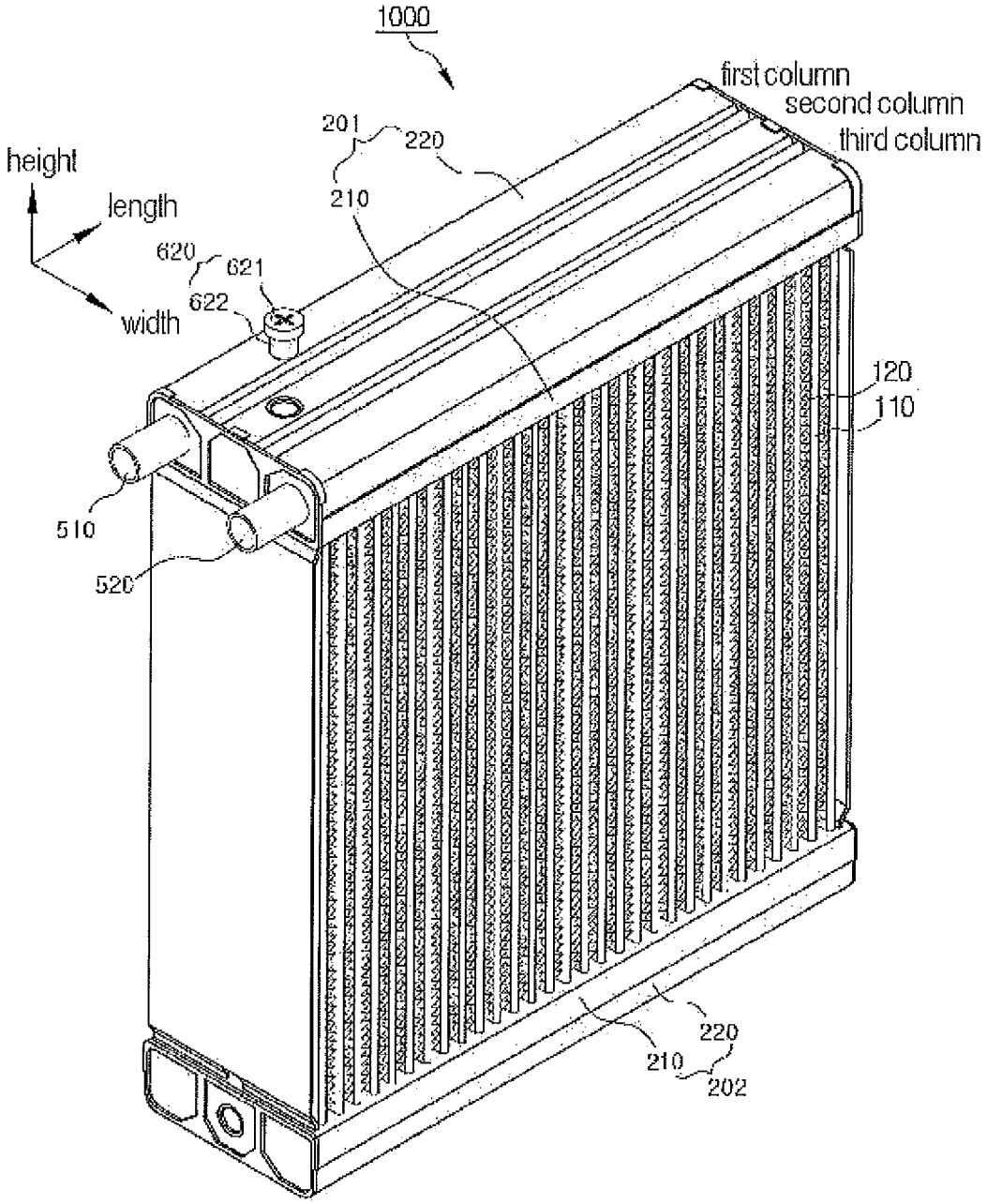
FIG. 13 is a perspective view illustrating the heat exchanger equipped with a cold reserving part according to another exemplary embodiment of the present invention.

Further, in the heat exchanger 1000 equipped with a cold reserving part illustrated in FIG. 13, an example in which the tank 220 forming the first header tank 201 is provided with the cold reserving material charging part is illustrated.

In this case, in addition to the example in which the heat exchanger 1000 equipped with a cold reserving part of the exemplary embodiment of the present invention is illustrated in FIG. 13, a manufacturing method of the first header tank 201 and the second header tank 202 and an internal shape thereof may be more variously modified.

Further, in addition to the shape in which the heat exchanger 1000 equipped with a cold reserving part of the exemplary embodiment of the present invention is illustrated in FIGS. 3 to 13, the number of columns, a location of the inlet pipe 510 and the outlet pipe 520, a shape of a heat exchange medium passage 111 depending on a shape of a baffle 230, a formation location of the communication part 214, and the like may be more variously formed.

Figure 10:
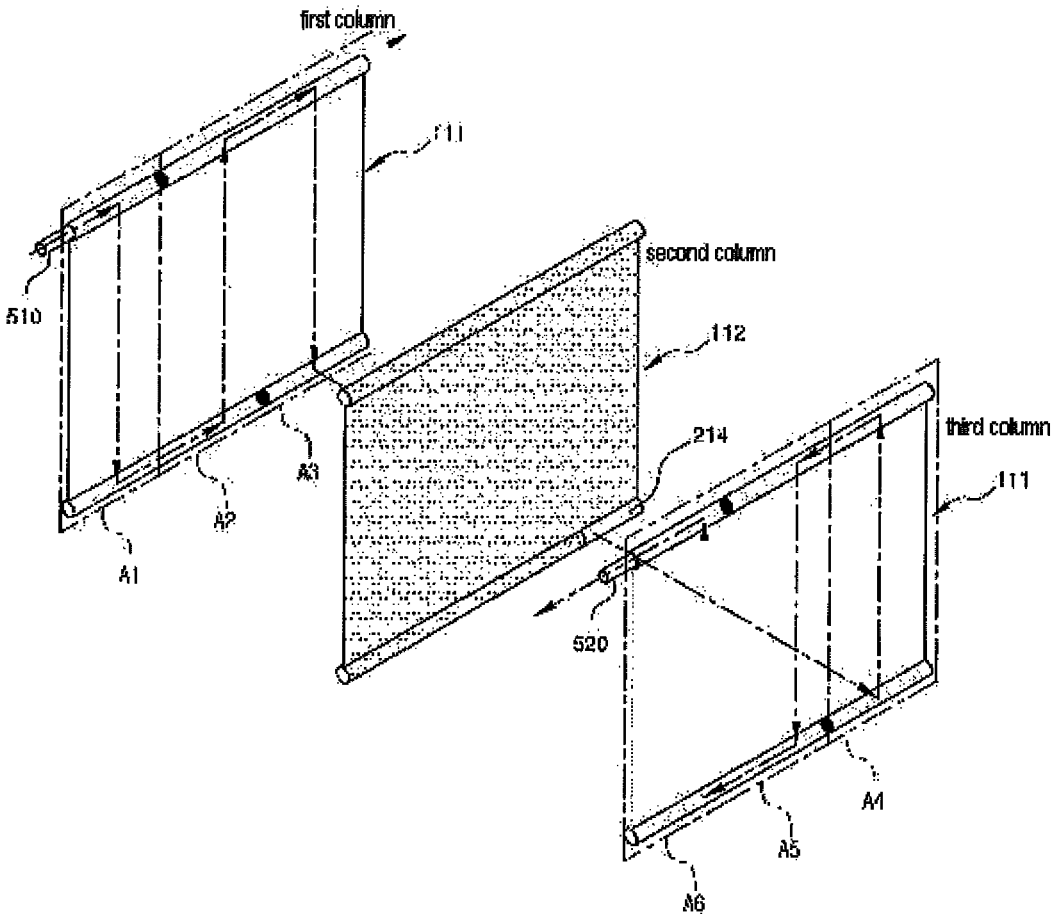
FIG. 10 is a diagram schematically illustrating a flow of a heat exchange medium of the heat exchanger equipped with a cold reserving part according to the exemplary embodiment of the present invention.

FIG. 10 is a diagram schematically illustrating a flow of the heat exchange medium of the heat exchanger 1000 equipped with a cold reserving part of the exemplary embodiment of the present invention, and in the heat exchanger 1000 equipped with a cold reserving part illustrated in FIG. 10, the heat exchange medium introduced through the inlet pipe 510 is discharged through the outlet pipe 520 via a first region A1 in which the heat exchange medium moves to the first compartment 213*a* of the second header tank 202 through a portion of the tube 110 forming the first column while being introduced into the first compartment 213*a* of the first header tank 201 and moving in a longitudinal direction; a second region A2 in which the heat exchange medium moves to the first compartment 213*a* of the first header tank 201 through the other portion of the tube 110 forming the first column while moving in a longitudinal direction of the first compartment 213*a* of the second header tank 202; a third region A3 in which the heat exchange medium moves to the first compartment 213*a* of the second header tank 202 through the remaining tube 110 forming the first column while moving in a longitudinal direction of the first compartment 213*a* of the first header tank 201; a fourth region A4 in which the heat exchange medium moves to the third compartment 213*c* of the second header tank 202 through the communication part 214 of the second compartment 213*b* of the second header tank 202 and then moves to the third compartment 213*c* of the first header tank 201 through a portion of the tube 110 forming the third column while moving in a longitudinal direction of the third compartment 213*c* of the second header tank 202; a fifth region A5 in which the heat exchange medium moves to the third compartment 213*c* of the second header tank 202 through the other portion of the tube 110 forming the third column while moving in the longitudinal direction of the third compartment 213*c* of the first header tank 201; and a sixth region A6 in which the heat exchange medium moves to the third compartment 213*c* of the first header tank 201 through the remaining tube 110 forming the third column while moving in the longitudinal direction of the third compartment 213*c* of the second header tank 202.

According to the exemplary embodiment of the present invention, the heat exchanger 1000 equipped with a cold reserving part may have various flows depending on the locations and number of baffles 230 inside the first header tank 201 and the second header tank 202.

Figure 17:
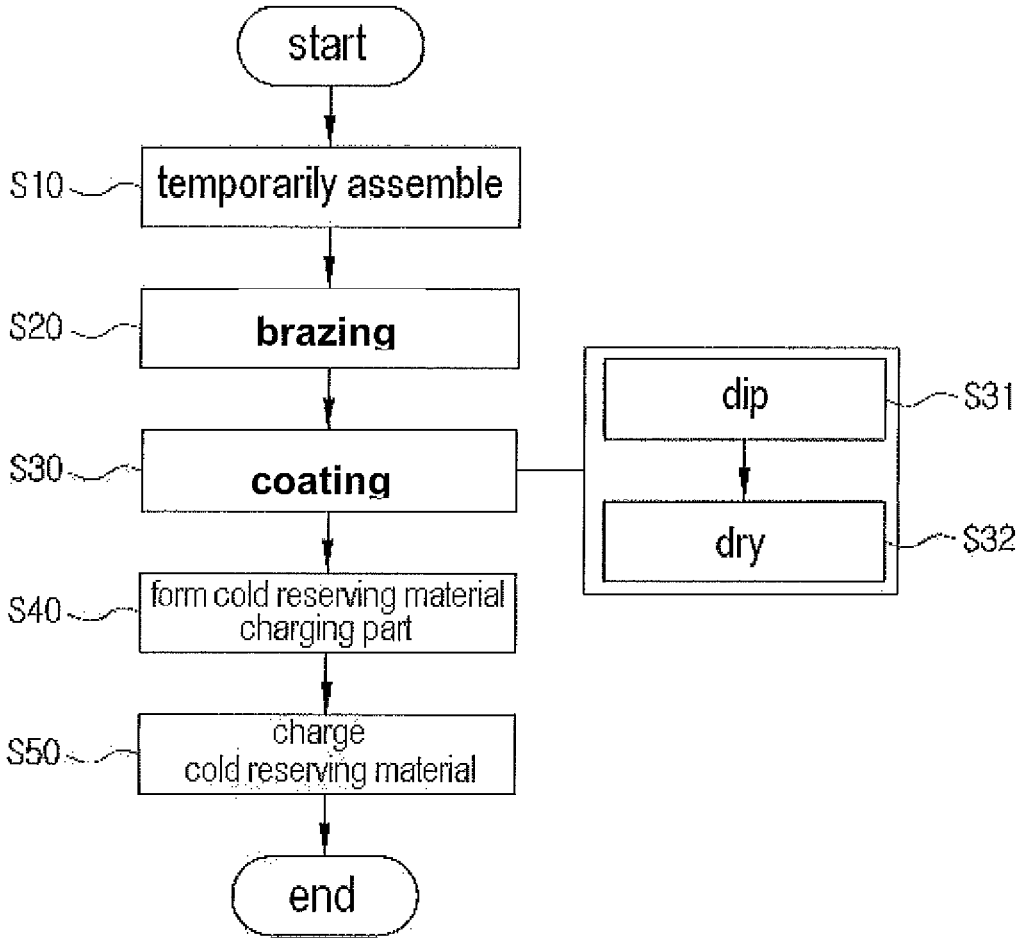
FIG. 17 is a process diagram illustrating a manufacturing method of a heat exchanger equipped with a cold reserving part according to an exemplary embodiment of the present invention.

Meanwhile, FIG. 17 is a process diagram illustrating the manufacturing method of a heat exchanger equipped with a cold reserving part according to the exemplary embodiment of the present invention is configured to include: temporarily assembling (S10): brazing (S20); coating (S30); forming the cold reserving material charging part (S40); and charging the cold reserving material (S50).

The temporarily assembling (S10) is a process of temporarily assembling the tube 110, the first header tank 201, the second header tank 202, the inlet pipe 510, and the outlet pipe 520 which are basic components for forming the heat exchanger 1000 equipped with a cold reserving part.

That is, the temporarily assembling (S10) is a process of assembling components which configure the heat exchanger 1000 equipped with a cold reserving part and the heat exchanger 1000 equipped with a cold reserving part temporarily assembled in the brazing is integrally formed.

The coating (S30) is a process of coating an outer surface using a coating solution and the coating solution used in the coating (S30) may be a material to suppress a mold, a smell, and the like from occurring due to condensed water of a surface of the heat exchanger 1000 equipped with a cold reserving part and a material to make hydrophilicity and water repellency good.

In more detail, the coating (S30) includes dipping (S41) and drying (S42).

The dipping (S41) is a process of dipping the brazed heat exchanger 1000 equipped with a cold reserving part into the coating solution, in which the overall heat exchanger 1000 equipped with a cold reserving part which is brazed excepting the predetermined region of the end of the inlet pipe 510 and the outlet pipe 520 is dipped into the coating solution so as to prevent the coating solution from being introduced thereinto.

The drying is a process of forming a coating layer on the outer surface by drying the heat exchanger 1000 equipped with a cold reserving part applied with the coating solution, which may be heated at a high temperature of 180 to 250° C.

The temperature of the drying (S42) may be appropriately controlled depending on physical properties of the coating solution.

In this case, according to the manufacturing method of the heat exchanger 1000 equipped with a cold reserving part, in the coating (S30), an internal space isolated from the outside excepting the inlet pipe 510 and the outlet pipe 520 for providing the introduction and discharging of the heat exchange medium is formed to prevent the coating solution from being introduced thereinto, thereby blocking the internal corrosion due to the coating solution.

The forming of the cold reserving material charging part (S40) is a process of forming the cold reserving material charging part 610 in the coated predetermined region of the heat exchanger 1000 equipped with a cold reserving part so as to store the cold reserving material in the specific column.

The charging of the cold reserving material (S50) is a process of charging the cold reserving material through the cold reserving material charging part 610 in the forming of the cold reserving material charging part (S40) and then closing the cold reserving material charging part 610.

As described above, in the heat exchanger 1000 equipped with a cold reserving part, the cold reserving material is stored in one of the first to third columns of the tube 110 and the heat exchange medium moves in the remaining columns.

Figure 18:
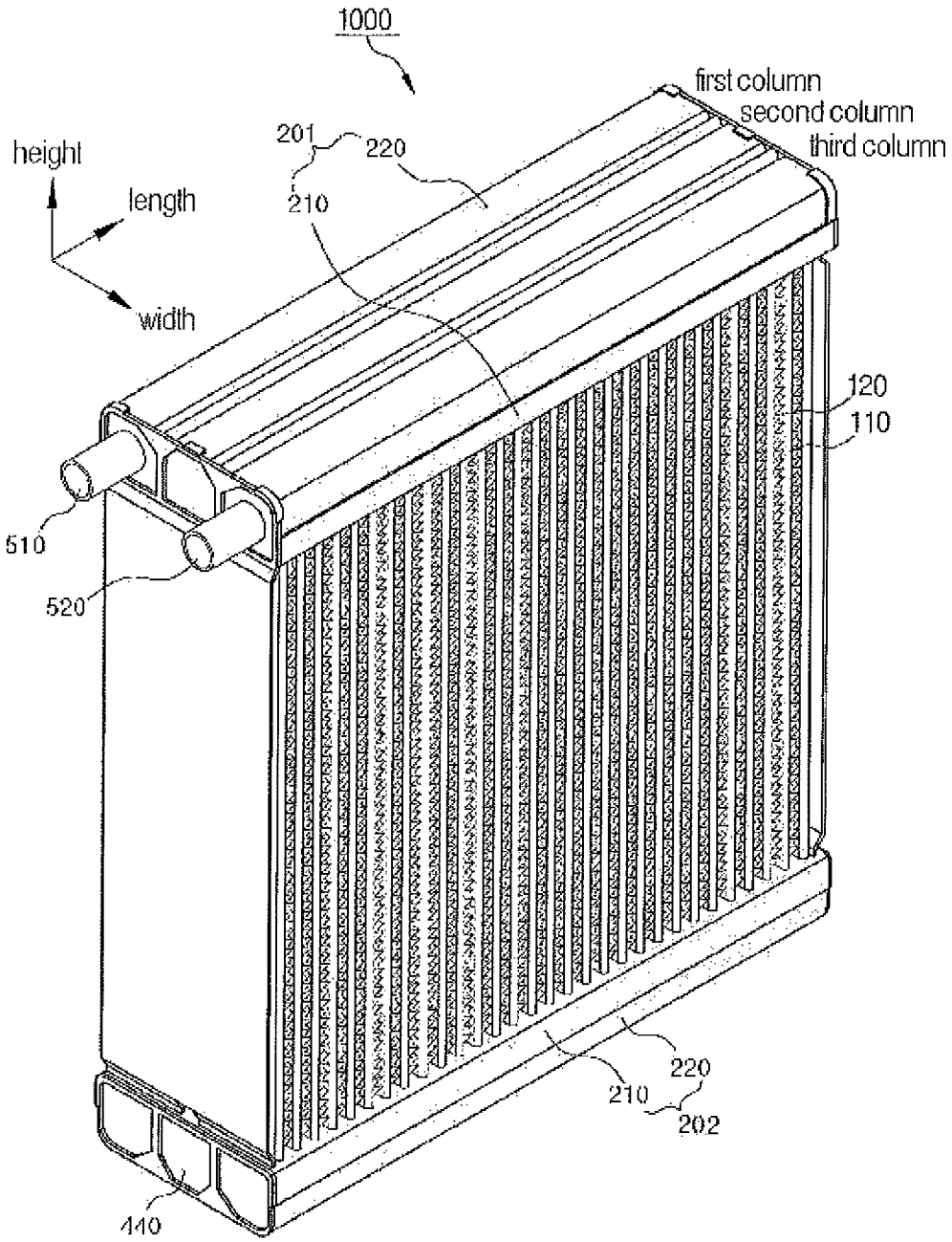
FIGS. 18 to 20 are diagrams illustrating each process of the manufacturing method of a heat exchanger equipped with a cold reserving part according to the exemplary embodiment of the present invention.
Figure 19:
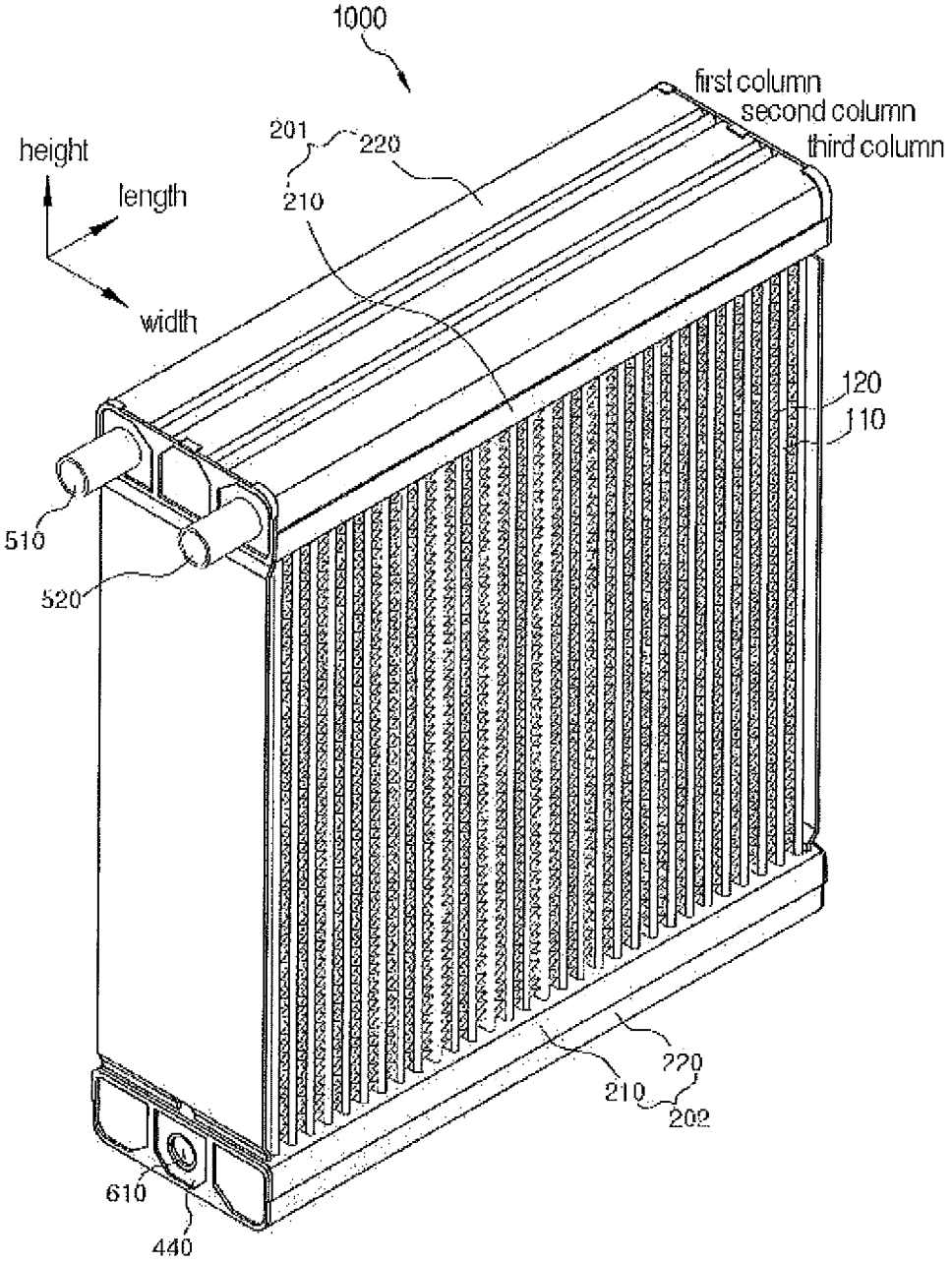
Figure 20:
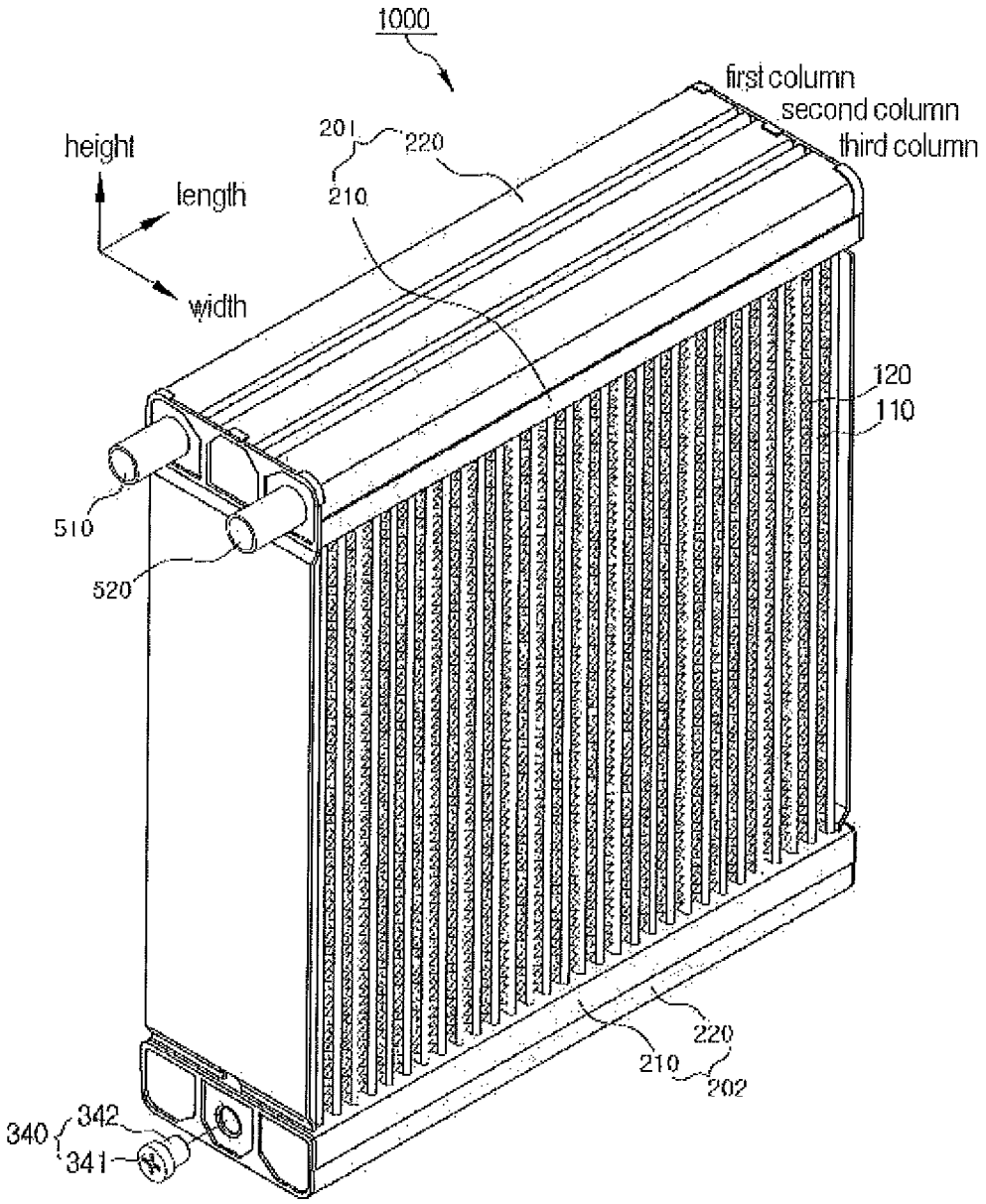

FIGS. 18 to 20 illustrates the heat exchanger 1000 equipped with a cold reserving part depending on each process when the cold reserving material charging part 610 is formed in the end cap 440.

In more detail, FIG. 18 illustrates the portion of the end cap 440 for charging the cold reserving material prior to the forming of the cold reserving material charging part (S40). In this case, the external and internal portions are divided in the state in which the end cap 440 is closed.

By doing so, the heat exchanger 1000 equipped with a cold reserving part according to the exemplary embodiment of the present invention may prevent the coating solution of the coating (S30) from being introduced thereinto.

FIG. 19 illustrates the state in which the forming of the cold reserving material charging part (S40) is performed and illustrates the state in which the cold reserving material charging part 610 is formed in the predetermined region of the end cap 440 for forming the cold reserving part 112.

FIG. 20 is a diagram for describing the charging of the cold reserving material (S50) and is a diagram for describing that the cold reserving material is charged through the cold reserving material charging part 610 and then the cold reserving material charging part 610 is closed.

In FIG. 20, as the configuration to close the cold reserving material charging part 610, an example in which the stopper 620 including the head part 621 and the fixed part 622 protruding at one portion of the head part 621 is used is illustrated.

In this case, the stopper 620 may be fixed by various fixing methods. For example, the stopper 620 may be fitted in.

That is, according to the manufacturing method of the heat exchanger 1000 equipped with a cold reserving part, the cold reserving part 112 is integrally formed to heat-exchange the heat exchange medium with the cold reserving material, thereby expecting a rapid and effective cold reserving effect and the cold reserving material is charged after the coating (S30), thereby effectively blocking the coating solution from being introduced thereinto.

In this case, the manufacturing method of the heat exchanger equipped with a cold reserving part according to the exemplary embodiment of the present invention, a support part 613 protruding in the inside or outside direction from the inner peripheral surface of the cold reserving material charging part 610 may be formed.

The support part 613 has a shape protruding to correspond to the fixed part 622 of the stopper 620, thereby improving the fixing force of the stopper 620 and detaching and attaching the stopper 620.

Even in the case in which the support part 613 is formed, the internal region of the support part 613 is in a closed state and the cold reserving material charging part 610 is formed in the internal closed region of the support part 613 through the charging of the cold reserving material (S50).

Figure 14:
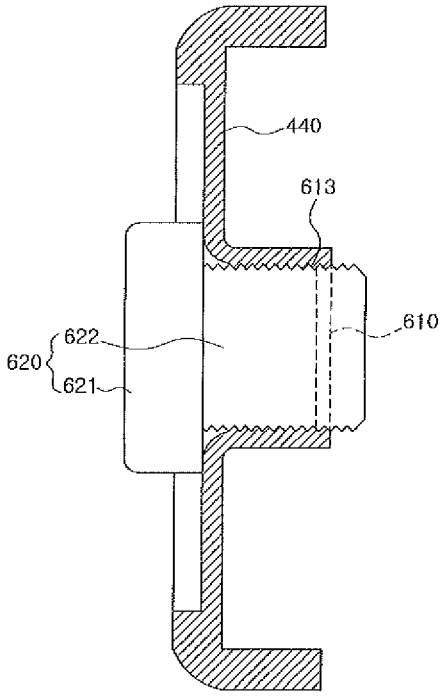
FIGS. 14 to 16C are various partial cross-sectional views illustrating a cold reserving material charging part of the heat exchanger equipped with a cold reserving part according to another exemplary embodiment of the present invention.

FIG. 14 illustrates a cross section when the support part 613 is further formed based on the state in which the stopper 620 of FIG. 20 is fastened and illustrates, by a dotted line, the form of the end cap 440 before the cold reserving material charging part 610 is formed.

(FIG. 16 illustrates, by a dotted line, the form of the end cap 440 before the cold reserving material charging part 610 is formed).

The fixed part 622 of the stopper 620 is provided with a screw thread and the inner peripheral surface of the support part 613 may have a shape corresponding to the fixed part 622 of the stopper 620 and the stopper 620 has a tap bolt shape and may have a structure in which the shape corresponding to the fixed part 622 is not previously machined at the support part 613 and the stopper 620 is directly fastened by rotating and inserting the region of the fixed part 622 of the stopper 620.

Further, the end cap 440 or the tank 220 formed with the cold reserving material charging part 610 may be provided with a step part 614 which is stepped inwardly so as to seat the head part 621 of the stopper 620 thereinto and as the step part 614 is formed, the portion protruding in the longitudinal direction of the heat exchanger 1000 equipped with a cold reserving part due to the stopper 620 may be minimized.

In this case, the overall shape of the end cap 440 first has a shape including the support part 613 and the step part 614 based on the finally manufactured state of the heat exchanger 1000 equipped with a cold reserving part and has a shape in which only the cold reserving material charging part 610 is not formed.

Further, in the charging of the cold reserving material (S50), at the time of closing the stopper 620, the sealing member 630 pressed by the head part 621 of the stopper 620 may be further provided.

That is, when the cold reserving material charging part 610 is formed in the end cap 440, the sealing member 630 is disposed between the head part 621 and the end cap 440 and when the cold reserving material charging part 610 is formed in the tank 220, the sealing member is disposed between the head part 621 and the tank 220.

Figure 15:
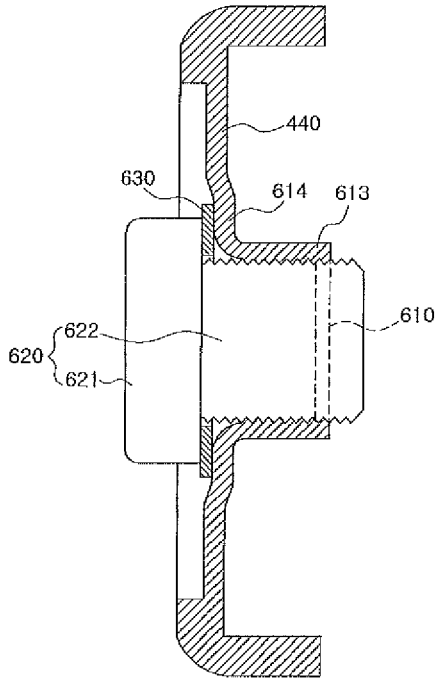

FIG. 15 is a diagram illustrating a shape of another end cap 440 of the heat exchanger 1000 equipped with a cold reserving part and illustrates an example in which the step part 614 is formed in the end cap 440 and the sealing member 630 is further provided.

Figure 16A:
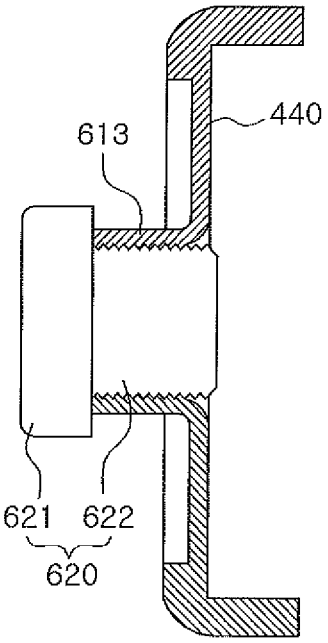
Figure 16B:
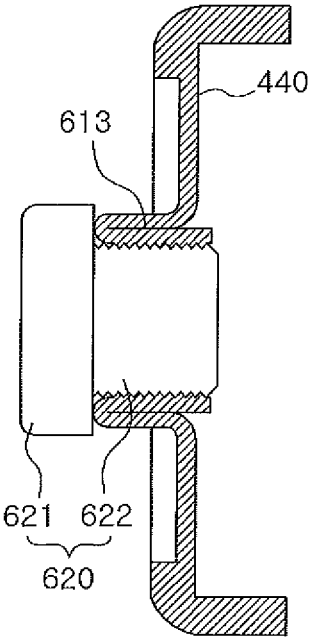
Figure 16C:
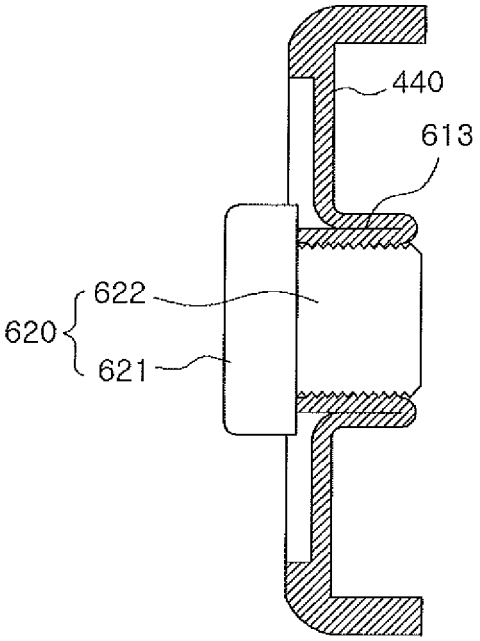

FIGS. 16A-16C illustrate various examples of the end cap 440, in which FIG. 16A illustrates an example in which the support part 613 protrudes in an outside direction of the end cap 440, compared with the shape illustrated in FIG. 14.

FIG. 16B is similar to the shape illustrated in FIG. 16A and illustrates an example in which the support part 613 is folded in two.

FIG. 16C is similar to the shape illustrated in FIG. 10 and illustrates an example in which the support part 613 is folded in two.

The manufacturing method of the heat exchanger equipped with a cold reserving part may close the cold reserving material charging part 610 by various fixing method in addition to the above method.

FIGS. 14 to 16C illustrate an example in which the cold reserving material charging part 610 is formed in the end cap 440, but in the heat exchanger 1000 equipped with a cold reserving part according to the exemplary embodiment of the present invention, the cold reserving material charging part 610 may be formed at more various locations, and even though the cold reserving material charging part 610 is formed in the tank 220, the support part 613 and the step part 614 may be further formed and the sealing member 630 may be further formed.

Figure 21:
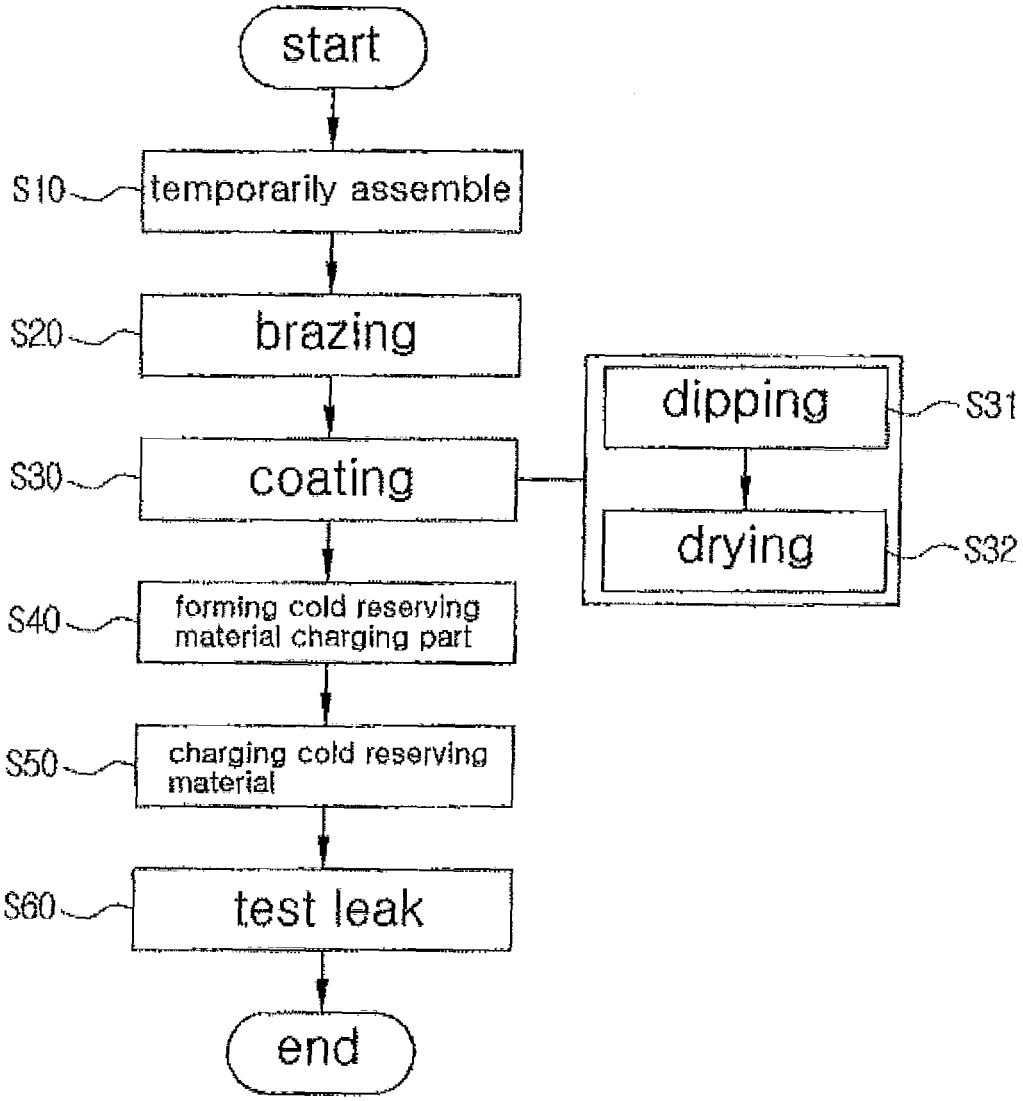
FIG. 21 is a process diagram illustrating a manufacturing method of a heat exchanger equipped with a cold reserving part according to another exemplary embodiment of the present invention.

FIG. 21 is a diagram illustrating a manufacturing method of a heat exchanger equipped with a cold reserving part according to another exemplary embodiment of the present invention and the manufacturing method of the heat exchanger equipped with a cold reserving part according to the exemplary embodiment of the present invention may further include testing whether the heat exchange medium and the cold reserving material are leaked (S60), after the charging of the cold reserving material (S50).

The testing whether the heat exchange medium and the cold reserving material are leaked (S60) is a process of testing the charging state of the cold reserving material and confirming the leakage of the heat exchange medium.

The heat exchanger 1000 equipped with a cold reserving part according to the exemplary embodiment of the present invention is manufactured by the manufacturing method having the above-mentioned features.

By doing so, according to the heat exchanger 1000 equipped with a cold reserving part and the manufacturing method of a heat exchanger equipped with a cold reserving part according to the present invention, the cold reserving material charging part to charge the cold reserving material after the coating (S30) is formed to block the coating solution from being introduced into the heat exchanger, thereby preventing the heat exchanger from corroding due to the coating solution to increase the durability and more increase the manufacturing performance.

The present invention is not limited the foregoing embodiments, but applications thereof may be various, and may be variously changed without departing from the scope of the present invention.

DESCRIPTION FOR REFERENCE NUMERALS

1000: Heat exchanger equipped with cold reserving part
110: Tube
111: Heat exchange medium passage
112: Cold reserving part
120: Fin
201: First header tank
202: Second header tank
210: Header 211: Plane part
211-1: Tube insertion hole
212: Coupling part 213: Barrier rib
213*a*: First compartment 213*b*: Second compartment
213*c*: Third compartment 214: Communication part
220: Tank
230: Baffle
300: Inlet and outlet forming member
400: Manifold
410: Lower manifold 420: Upper manifold
421: Hollow part
431: First region 432: Second region
433: First extension 434: Second extension
440: End cap 441: First hole
442: Second hole 443: Third hole
510: Inlet pipe 520: Outlet pipe
610: Cold reserving material charging part
611: Screw thread
612: Seating groove 613: Support part
614: Step part
620: Stopper
621: Head part 622: Fixing part
630: Sealing member
S10 To S50: Each process of manufacturing method of heat exchanger equipped with cold reserving part
A1 To A6: Heat exchange medium moving region of heat exchanger equipped with cold reserving part

The invention claimed is:

1. A heat exchanger comprising:

a first header tank having an inlet and outlet forming member coupled thereto, the inlet and outlet forming member of the first header tank configured to introduce a heat exchange medium to and discharge the heat exchange medium from the first header tank;

a second header tank spaced from and in parallel with the first header tank;

a plurality of barrier ribs disposed in each of the first header tank and the second header tank, the plurality of barrier ribs partitioning each of the first header tank and the second header tank into a first compartment, a second compartment, and a third compartment;

a first column of tubes extending between the first compartment of the first header tank and the first compartment of the second header tank;

a second column of tubes extending between the second compartment of the first header tank and the second compartment of the second header tank;

a third column of tubes extending between the third compartment of the first header tank and the third compartment of the second header tank, one of the first column of tubes, the second column of tubes, and the third column of tubes configured to receive a cold reserving material therein; and a cold reserving material charging part coupled to the first header tank and in fluid communication with the one of the first column of tubes, the second column of tubes, and the third column of tubes configured to receive the cold reserving material therein, wherein the second column of tubes is intermediate the first column of tubes and the third column of tubes, the first column of tubes and the third column of tubes configured to receive the heat exchange medium therein, the second column of tubes configured to receive the cold reserving material therein, wherein a communication part is disposed in the second compartment of each of the first header tank and the second header tank, the communication part providing fluid communication between the first compartment and the third compartment of each of the first header tank and the second header tank.

2. The heat exchanger of claim 1, wherein the inlet and outlet forming member includes an inlet pipe and an outlet pipe, the inlet pipe configured to convey the heat exchange material to the first compartment of the first header tank, the outlet pipe configured to convey the heat exchange material from the third compartment of the first header tank.

3. The heat exchanger of claim 2, wherein the first header tank, the second header tank, the first column of tubes, the third column of tubes, and the communication part cooperate to form a flow path configured to convey the heat exchange material therethrough, the flow path formed intermediate the inlet pipe and the outlet pipe.

4. The heat exchanger of claim 3, wherein the flow path is divided into a first region, a second region, a third region, a fourth region, a fifth region, and a sixth region.

5. The heat exchanger of claim 4, wherein the first region is formed adjacent the inlet pipe and is defined by a first longitudinal portion of the first compartment of the first header tank and a first tube in the first column of tubes, the first tube in the first column of tubes extending from the first longitudinal portion of the first compartment of the first header tank, wherein the second region is formed adjacent the first region and is defined by a first longitudinal portion of the first compartment of the second header tank and a second tube in the first column of tubes, the second tube in the first column of tubes extending from the first longitudinal portion of the first compartment of the second header tank, and wherein the third region is formed adjacent the second region and is defined by a second longitudinal portion of the first compartment of the first header tank and a third tube in the first column of tubes, the third tube in the first column of tubes extending from the second portion of the first compartment of the first header.

6. The heat exchanger of claim 5, wherein the fourth region is formed adjacent the third region and is defined by the communication part of the second header, a first tube of the third column of tubes, and a first longitudinal portion of the third compartment of the first header, the first tube of the third column of tubes extending from the first longitudinal portion of the third compartment of the first header.

7. The heat exchanger of claim 6, wherein the fifth region is formed adjacent the fourth region and is defined by a second tube in the third column of tubes and a first longitudinal portion of the third compartment of the second header, the second tube in the third column of tubes extending from the first longitudinal portion of the third compartment of the first header, and wherein the sixth region is formed intermediate the fifth region and the outlet pipe and is defined by a third tube in the third column of tubes and a second longitudinal portion of the third compartment of the first header, the third tube in the third column of tubes extending from the first longitudinal portion of the third compartment of the second header.

8. A heat exchanger comprising:

a first header tank having an inlet and outlet forming member coupled thereto, the inlet and outlet forming member of the first header tank configured to introduce a heat exchange medium to and discharge the heat exchange medium from the first header tank;

a second header tank spaced from and in parallel with the first header tank;

a plurality of barrier ribs disposed in each of the first header tank and the second header tank, the plurality of barrier ribs partitioning each of the first header tank and the second header tank into a first compartment, a second compartment, and a third compartment;

a first column of tubes extending between the first compartment of the first header tank and the first compartment of the second header tank;

a second column of tubes extending between the second compartment of the first header tank and the second compartment of the second header tank;

a third column of tubes extending between the third compartment of the first header tank and the third compartment of the second header tank, one of the first column of tubes, the second column of tubes, and the third column of tubes configured to receive a cold reserving material therein;

a cold reserving material charging part coupled to the first header tank and in fluid communication with the one of the first column of tubes, the second column of tubes, and the third column of tubes configured to receive the cold reserving material therein; and an end cap disposed intermediate the first header tank and the inlet and outlet faulting member, the end cap providing fluid communication between an inlet pipe of the inlet and outlet forming member and the first compartment of the first header tank and between an outlet pipe of the inlet and outlet forming member and the third compartment of the first header tank, wherein the cold reserving material charging part extends through the end cap, and wherein the second column of tubes is intermediate the first column of tubes and the third column of tubes, the first column of tubes and the third column of tubes configured to receive the heat exchange medium therein, the second column of tubes configured to receive the cold reserving material therein.

9. A heat exchanger comprising:

a first header tank having an inlet and outlet forming member coupled thereto, the inlet and outlet forming member of the first header tank configured to introduce a heat exchange medium to and discharge the heat exchange medium from the first header tank;

a second header tank spaced from and in parallel with the first header tank;

a plurality of barrier ribs disposed in each of the first header tank and the second header tank, the plurality of barrier ribs partitioning each of the first header tank and the second header tank into a first compartment, a second compartment, and a third compartment;

a first column of tubes extending between the first compartment of the first header tank and the first compartment of the second header tank;

a second column of tubes extending between the second compartment of the first header tank and the second compartment of the second header tank;

a third column of tubes extending between the third compartment of the first header tank and the third compartment of the second header tank, one of the first column of tubes, the second column of tubes, and the third column of tubes configured to receive a cold reserving material therein; and a cold reserving material charging part coupled to the first header tank and in fluid communication with the one of the first column of tubes, the second column of tubes, and the third column of tubes configured to receive the cold reserving material therein, wherein the second column of tubes is intermediate the first column of tubes and the third column of tubes, the first column of tubes and the third column of tubes configured to receive the heat exchange medium therein, the second column of tubes configured to receive the cold reserving material therein, wherein the inlet and outlet forming member includes a manifold coupling an inlet pipe of the inlet and outlet forming member and an outlet pipe of the inlet and outlet forming member to the first header tank, the cold reserving material charging part extending through the manifold, and wherein the manifold is divided into a lower manifold and an upper manifold aligning with each other and forming a U shape, each of the lower manifold and the upper manifold having a hollow part formed therein receiving the cold reserving material charging part.

10. The heat exchanger of claim 1, further comprising a stopper including a head part and a fixed part extending from the head part, the stopper configured to close the cold reserving material charging part.

11. The heat exchanger of claim 10, wherein an inner peripheral surface of the cold reserving material charging part includes a support part extending therefrom, the support part configured to receive the stopper.

12. The heat exchanger of claim 10, further comprising a sealing member disposed intermediate the head part and the cold reserving material charging part, wherein the cold reserving material charging part includes a seating groove formed therein configured to receive the sealing member.

13. A heat exchanger comprising:

a first header tank having an inlet and outlet forming member coupled thereto, the inlet and outlet forming member of the first header tank configured to introduce a heat exchange medium to and discharge the heat exchange medium from the first header tank;

a second header tank spaced from and in parallel with the first header tank;

a plurality of barrier ribs disposed in each of the first header tank and the second header tank, the plurality of barrier ribs partitioning each of the first header tank and the second header tank into a first compartment, a second compartment, and a third compartment;

a first column of tubes extending between the first compartment of the first header tank and the first compartment of the second header tank;

a second column of tubes extending between the second compartment of the first header tank and the second compartment of the second header tank;

a third column of tubes extending between the third compartment of the first header tank and the third compartment of the second header tank, one of the first column of tubes, the second column of tubes, and the third column of tubes configured to receive a cold reserving material therein; and a cold reserving material charging part coupled to the first header tank and in fluid communication with the one of the first column of tubes, the second column of tubes, and the third column of tubes configured to receive the cold reserving material therein, wherein each of the tubes in the first column of tubes, the second column of tubes, and the third column of tubes is an extrusion type tube, wherein each of the tubes of the first column of tubes is integrally formed with one of the tubes of the second column of tubes and one of the tubes of the third column of tubes, and wherein a plurality of fins is interposed between each of the tubes of the first column of tubes, each of the tubes of the second column of tubes, and each of the tubes of the third column of tubes.

* * * * *